United States Patent [19]

Matsuzaka et al.

[11] Patent Number: 4,917,996

[45] Date of Patent: Apr. 17, 1990

[54] SILVER HALIDE GRAINS, PREPARATION THEREOF AND LIGHT-SENSITIVE PHOTOGRAPHIC MATERIAL CONTAINING SAID GRAINS

[75] Inventors: Syoji Matsuzaka; Hideo Akamatsu; Shu Nishiwaki; Yoshihiko Suda, all of Hino, Japan

[73] Assignee: Konishiroku Photo Industry Co., Ltd., Tokyo, Japan

[21] Appl. No.: 185,081

[22] Filed: Apr. 22, 1988

[30] Foreign Application Priority Data

| | | | |
|---|---|---|---|
| Jul. 28, 1984 | [JP] | Japan | 59-158111 |
| Oct. 1, 1984 | [JP] | Japan | 59-206765 |
| Oct. 8, 1984 | [JP] | Japan | 59-211763 |
| Oct. 8, 1984 | [JP] | Japan | 59-211764 |

[51] Int. Cl.[4] ..... G03C 1/02

[52] U.S. Cl. ..... 430/567; 430/569

[58] Field of Search ..... 430/567, 569, 502, 503, 430/505, 486

[56] References Cited

U.S. PATENT DOCUMENTS

| | | | |
|---|---|---|---|
| 2,835,581 | 6/1955 | Tinker et al. | 430/602 |
| 3,689,270 | 9/1972 | Anderson et al. | 430/9 |
| 3,817,756 | 6/1974 | Claes et al. | 430/567 |
| 3,885,970 | 5/1975 | Miyahara | 430/567 |
| 4,400,463 | 8/1983 | Maskasky | 430/567 |
| 4,463,087 | 7/1984 | Maskasky | 430/570 |
| 4,496,652 | 1/1985 | Haugh et al. | 430/567 |
| 4,643,966 | 2/1987 | Maskasky | 430/567 |
| 4,680,254 | 7/1987 | Maskasky | 430/567 |
| 4,680,255 | 7/1987 | Maskasky | 430/567 |
| 4,680,256 | 7/1987 | Maskasky et al. | 430/567 |
| 4,683,192 | 4/1985 | Nishiyama | 430/567 |
| 4,724,200 | 2/1988 | Maskasky | 430/567 |

FOREIGN PATENT DOCUMENTS

| | | |
|---|---|---|
| 0145440 | 6/1985 | European Pat. Off. . |
| 0213963 | 3/1987 | European Pat. Off. . |
| 1900780 | 10/1969 | Fed. Rep. of Germany . |
| 2932185 | 2/1980 | Fed. Rep. of Germany . |
| 3514280 | 10/1985 | Fed. Rep. of Germany . |
| 2137880 | 12/1972 | France . |
| 1027146 | 4/1966 | United Kingdom . |

OTHER PUBLICATIONS

B. A. Scott, "Tabular Grain Silver Halide Emulsions" The British Journal of Photography, Feb. 25, 1983.

Research Disclosure, No. 181, May 1979, pp. 265–268, No. 18155, Havant, Hampshire, GB; F. J. Evans et al., Journal of Imaging Science, vol. 30, No. 6, Nov./Dec. 1986, pp. 247–254, Society of Photographic Scientists and Engineers, Springfield, VA, US: J. E. Maskasky.

*Primary Examiner*—Paul R. Michl

*Assistant Examiner*—Lee C. Wright

[57] ABSTRACT

Disclosed are silver halide grains which has (110) crystal faces and comprises a silver halide composition consisting substantially of silver bromide or silver iodobromide; a preparation thereof which comprises controlling pAg at 8.0 to 9.5 during a period until at least 30 mole % of the total silver halide is formed in the step of preparing the silver halide grains while permitting at least one selected from the compounds represented by the formula (I), (II), (III) or (IV) shown below and the compounds having the recurring units represented by the formula (V) shown below to exist during the period:

Formula (I)

Formula (II)

Formula (III)

(Abstract continued on next page.)

-continued

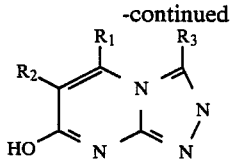

Formula (IV)

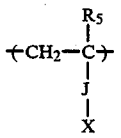

Formula (V)

wherein $R_1$, $R_2$ and $R_3$, which may be either the same or different, each represent a hydrogen atom, a halogen atom, a hydroxyl group, an amino group, a derivative of an amino group, an alkyl group, a derivative of an alkyl group, an aryl group, a derivative of an aryl group, a cycloalkyl group, a derivative of a cycloalkyl group, a mercapto group, a derivative of an mercapto group or —CONH—$R_4$ ($R_4$ is a hydrogen atom, an amino group, a derivative of an alkyl group, a derivative of an amino group, a halogen atom, a cycloalkyl group, a derivative of a cycloalkyl group, an aryl group or a derivative of an aryl group), $R_1$ and $R_2$ may be bonded together to form a ring, $R_5$ represents a hydrogen atom or an alkyl group, X represents a monovalent group formed by eliminating one hydrogen atom from the compounds represented by the formula (I), (II), (III) or (IV), and J represents a divalent linking group; and a light-sensitive silver halide photographic material having a light-sensitive silver halide emulsion layer on a support, the emulsion layer containing silver halide grains having (110) crystal faces and comprising a silver halide composition consisting substantially of silver bromide or silver iodobromide, or at least one of the light-sensitive emulsion layers containing silver halide grains having semi-(110) faces and comprising a silver halide composition consisting substantially of silver bromide or silver iodobromide.

7 Claims, 13 Drawing Sheets

SILVER HALIDE GRAINS, PREPARATION THEREOF AND LIGHT-SENSITIVE PHOTOGRAPHIC MATERIAL CONTAINING SAID GRAINS

This is a division of Ser. No. 070,169, filed July 2, 1987, now U.S. Pat. No. 4,775,615, which is a continuation of Ser. No. 758,550, filed July 24, 1985, now abandoned.

BACKGROUND OF THE INVENTION

This invention relates to light-sensitive silver halide grains suitable for higher sensitization, preparation thereof and light-sensitive silver halide photographic materials.

The present invention further concerns silver halide emulsions having epitaxial hybridized silver salt crystals comprising developable silver salt crystals such as silver chloride, silver halochloride, etc. epitaxially junctioned onto silver iodobromide or silver bromide host crystals, which are excellent in sensitivity and developability.

In recent years, silver halide emulsions for photography are required to satisfy requirements, which are increasingly severe, namely to have high levels of performances such as high sensitivity, excellent graininess, high sharpness, low fog density and sufficiently high optical density.

As a high sensitivity emulsion responding to such requirements, silver iodobromide emulsions containing 0 to 10 mol % of iodine are well known in the art. And, as the methods for preparing these emulsions, there have been known the methods in which pH condition and pAg condition are controlled such as the ammoniacal method, the neutral method, the acidic method, etc. and the mixing methods such as the single jet method, the double jet method, etc.

On the basis of these known techniques, in order to accomplish further higher sensitization, improvement of graininess, high sharpness and low fog, very precise technical means have been investigated and practically applied. In the silver iodobromide emulsion aimed at by the present invention, studies have been done even about the emulsions controlled in concentration distributions of iodine within the individual silver halide grains, to say nothing of crystal habits and grain size distribution.

The most orthodox method for accomplishing photographic performances such as high sensitivity, excellent graininess, high sharpness, low fog density and sufficiently high covering power is to improve the quantum efficiency of a silver halide. For this purpose, the knowledges about solid physics have positively been applied. The study having calculated theoretically the quantum efficiency and speculating about the effect of grain size distribution is disclosed in, for example, the pretext of Tokyo Symposium concerning Progress in Photography in 1980, entitled "Interactions between Light and Materials for Photographic Applications", on page 91. According to this study, it is predicted to be effective for improvement of quantum efficiency to prepare a mono-dispersed emulsion by narrowing the grain size distribution. In addition, for accomplishing sensitization of a silver halide emulsion, in the step of chemical sensitization as described hereinafter in detail, it may be considered resonable to estimate that a mono-dispersed emulsion would be advantageous for accomplishing efficiently high sensitivity while maintaining low fogging.

For preparation of a mono-dispersed emulsion in industry, it is necessary to control the feeding rate of silver ions and halogen ions to the reaction system theoretically determined under sufficient stirring conditions, on the basis of pAg and pH strictly controlled, as disclosed in Japanese Provisional Patent Publication No. 48521/1979. The silver halide emulsions prepared under these conditions comprise the so-called normal crystal grains having (100) faces and (111) faces having either cubic, octahedral or tetradecahedral shapes at various proportions. And, higher sensitization has been known to be possible with such normal crystal grains.

On the other hand, a silver iodobromide emulsion comprising poly-dispersed twin crystal grains has been known in the art as a silver halide emulsion suitable for high sensitivity photographic film.

Also, in Japanese Provisional Patent Publication No. 113,927/1983 and others, a silver halide emulsion containing flat plate twin crystal grains is disclosed.

Although these techniques contribute to higher sensitization, demands for techniques capable of accomplishing further higher sensitization always exist.

On the other hand, as the technique for broadening exposure region, there has been known a technique to employ two or more kinds of emulsions with different sensitivities according to a means such as mixing of two or more kinds of emulsions with different average grain sizes.

By combination of the above higher sensitization technique and the technique for broadening exposure region, it is possible to obtain a light-sensitive photographic material having high sensitivity to some extent and a broad exposure region. However, development of techniques capable of realizing further higher demands in such aspects exists continuously.

On the other hand, a silver halide emulsion containing epitaxial hybridized silver halide crystals comprising polygonal crystals of silver iodide and silver chloride crystals formed through epitaxial junction onto the polygonal crystals is known to have both radiation sensitivity of silver iodide and rapid developability of silver chloride, and also release a relatively large quantity of iodide ions when developed, thereby giving a preferable photographic effect by the iodide ions, as disclosed in Japanese Provisional Patent Publication No. 10372/1978.

As the technique for improving the processability of this emulsion, European Patent Application No. 0,019,917 (published on December 10, 1980) discloses a silver halide emulsion containing crystals of a silver halide with less than 10 mole % of silver iodide formed through epitaxial junction onto silver halide crystals containing 15 to 40 mol % of silver iodide.

Further, the technique in which use of highly concentrated iodide is avoided in the host grains in the above emulsion is disclosed in Japanese Provisional Patent Publication No. 133,540/1984. In this technique, silver iodobromide with low content of silver iodide is employed as the host grains.

By use of these techniques, light-sensitive photographic materials capable of giving images excellent in sharpness through the edge effect can be obtained, but they are still low in sensitivity for practical application and therefore it is further required to develop a technique to enhance sensitivity.

SUMMARY OF THE INVENTION

An object of the present invention is to provide firstly silver halide grains and a light-sensitive silver halide photographic material excellent in sensitivity-fog relationship, and secondly a process for preparation of the above silver halide grains.

Another object of the present invention is to provide a light-sensitive silver halide photographic material excellent in graininess, sharpness and sensitivity-fog relationship and also broad in exposure region, and further light-sensitive silver halide grains suitable for the light-sensitive silver halide photographic material as mentioned above.

Still another object of the present invention is to provide a silver halide photographic emulsion and a light-sensitive silver halide photographic material containing epitaxial hybridized silver salt crystals having excellent developing effect (the effect of improving sharpness through the edge effect) and developability, and also having improved sensitivity.

The first object of the present invention can be accomplished by silver halide grains having (110) crystal faces and comprising a silver halide composition consisting substantially of silver bromide or silver iodobromide and a light-sensitive silver halide photographic material having a light-sensitive silver halide emulsion on a support, wherein said emulsion layer comprises silver halide grains having (110) crystal faces and comprising a silver halide composition consisting substantially of silver bromide or silver iodobromide.

Also, in other words, the object of the present invention can be accomplished by a process for producing silver halide grains, which comprises controlling pAg at 8.0 to 9.5 during a period until at least 30 mole % of the total silver halide is formed in the step of preparing the silver halide grains while permitting at least one compound selected from the compounds represented by the formula (I), (II), (III) or (IV) shown below and the compounds having the recurring units represented by the formula (V) shown below to exist during said period:

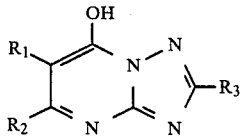

Formula (I)

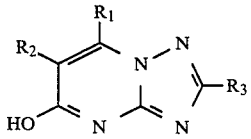

Formula (II)

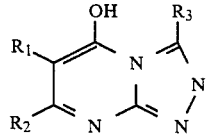

Formula (III)

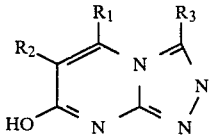

Formula (IV)

-continued

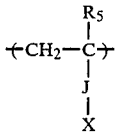

Formula (V)

wherein $R_1$, $R_2$ and $R_3$, which may be either the same or different, each represent a hydrogen atom, a halogen atom, a hydroxyl group, an amino group, a derivative of an amino group, an alkyl group, a derivative of an alkyl group, an aryl group, a derivative of an aryl group, a cycloalkyl group, a derivative of a cycloalkyl group, a mercapto group, a derivative of a mercapto group or —CONH—$R_4$ ($R_4$ is a hydrogen atom, an alkyl group, an amino group, a derivative of an alkyl group, a derivative of an amino group, a halogen atom, a cycloalkyl group, a derivative of a cycloalkyl group, an aryl group or a derivative of an aryl group), $R_1$ and $R_2$ may be bonded together to form a ring (for example, a carbon ring of 5 to 7 membered or a heterocyclic ring), $R_5$ represents a hydrogen atom or an alkyl group, X represents a monovalent group formed by eliminating one hydrogen atom from the compounds represented by the formula (I), (II), (III) or (IV) (for example, those formed by eliminating one hydrogen atom from $R_1$ to $R_3$ or OH group of the aforesaid compounds represented by the formulae (I) to (IV)), and J represents a divalent linking group.

The above objects of the present invention can also be accomplished by silver halide grains having crystals faces having ridgelines on the center of (110) faces and comprising a silver halide composition consisting substantially of silver bromide or silver iodobromide.

Also, above objects of the present invention can be accomplished by a light-sensitive silver halide material having a light-sensitive emulsion layer on a support, wherein at least one layer of the light-sensitive silver halide emulsion layers containg silver halide grains having crystals faces having ridgelines on the center of (110) faces and comprising a silver halide composition consisting substantially of silver bromide or silver iodobromide.

The other objects of the present invention can be accomplished by a silver halide photographic emulsion containing hybridized silver salt crystals comprising developable silver salt crystals formed through epitaxial junction onto host grains consisting substantially of silver iodobromide or silver bromide having (110) faces and/or faces having ridgelines on the (110) faces, and a light-sensitive silver halide photographic material having at least one silver halide photographic emulsion layer on a support, wherein said silver halide emulsion layer contains hybridized silver salt crystals comprising developable silver salt crystals formed through epitaxial junction onto host grains consisting substantially of silver iodobromide or silver bromide having (110) faces and/or faces having ridgelines on the (110) faces.

The objects of the present invention can further be accomplished by a light-sensitive silver halide photographic material containing silver halide grains having crystal faces having ridgelines at the center of the (110) faces and/or (110) faces, and having also the core/shell structure, comprising a silver halide composition consisting substantially of silver iodobromide, and also by silver halide grains having crystal faces having ridgelines at the center of the (110) faces and/or (110) faces, and having also the core/shell structure, comprising a silver halide composition consisting substantially of silver iodobromide.

BRIEF DESCRIPTION OF THE DRAWINGS

FIGS. 19 to 24 are electron microscopic photographs of the silver halide grains of the present invention;

FIGS. 18 and 25 those of the silver halide grains for comparative purpose;

FIGS. 26 to 29 those of the silver halide grains of the present invention;

FIGS. 30 and 31 are electron microscopic photographs of the hybridized silver halide crystals of the present invention; and FIG. 32 shows the characteristic curve of Example 17.

DESCRIPTION OF THE PREFERRED EMBODIMENTS

Figure 1:
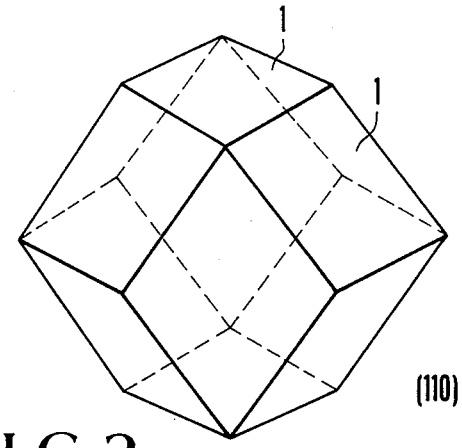
FIGS. 1 to 9 are illustrations showing the respective crystal forms of silver halide grains having (110) faces of the present invention.
Figure 2:
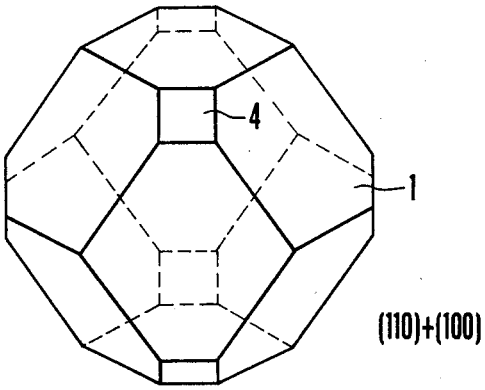
Figure 3:
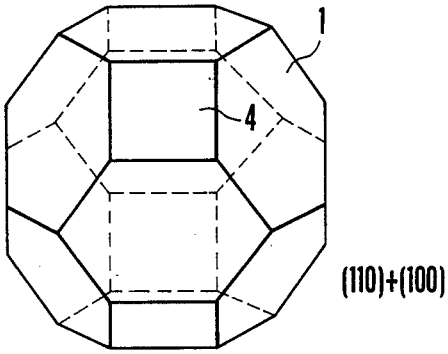
Figure 4:
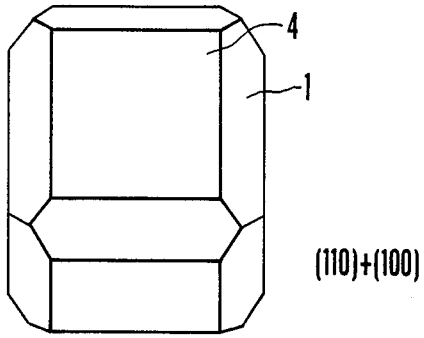
Figure 5:
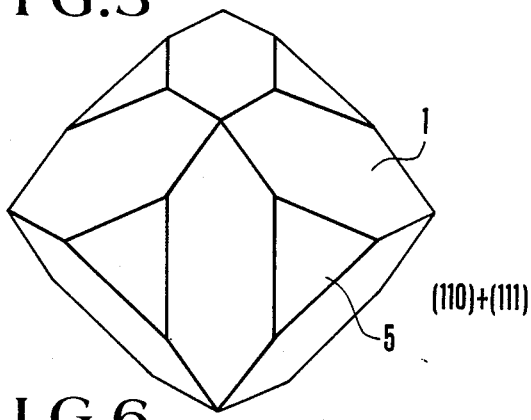
Figure 6:
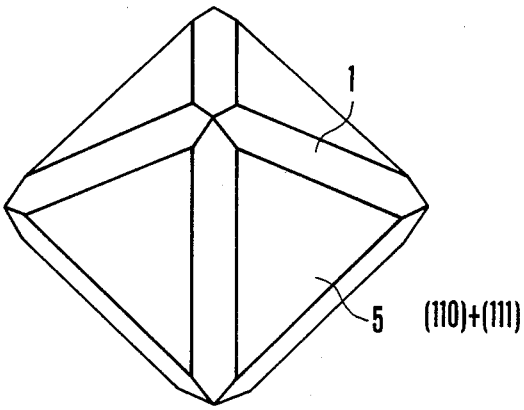
Figure 7:
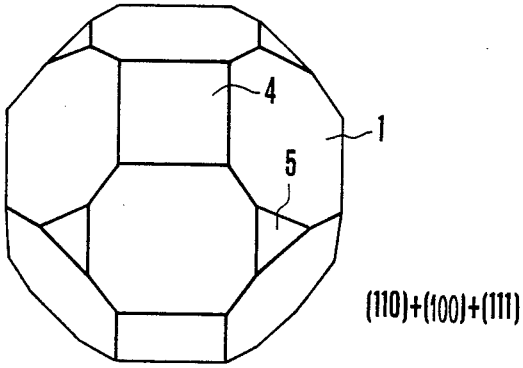
Figure 8:
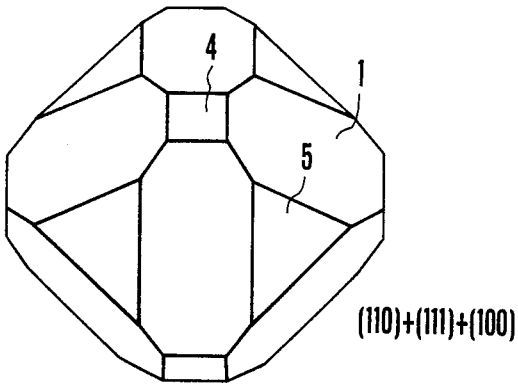
Figure 9:
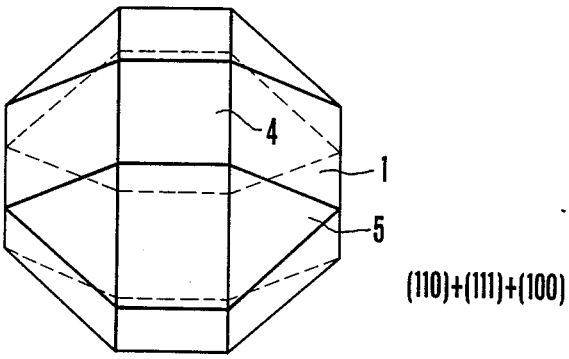

The silver halide grains according to the present invention are crystals having Miller indices (110) face and/or crystal face having ridgeline at the center of the Miller indices (110) face (hereinafter called as semi-(110) face) on their outer surfaces, which may be either normal crystals or twin crystals (including multiple twins). Said grains include those corresponding to at least one item of the following items (1) to (4) in crystal forms.

(1) The proportion of the surface area of (110) faces to the total surface area is at least 30%. In determination of this proportion, when the boundary between the two crystal faces is unclear (for example, because the boundary has a roundness, etc.), the line of intersection of these two faces is determined as the boundary.

(2) To belong to the scope of the crystal forms as shown in FIGS. 1 to 17 given below wherein 1 shows (110) face, 2 semi-(110) face, 3 a central ridgeline of the (110) face, 4 (100) face and 5 (111) face.

(3) To belong to the scope of the crystal forms as shown in the electron microscope photographs in FIGS. 19 to 24 and FIGS. 26 to 31 given below.

(4) Those having ratios of respective diffraction line intensities at the (111) face, (200) face and (220) face of said emulsion coated with orientation on a substrate as measured by the powder X-ray diffraction (see Bulletin of the Society of Scientific Photography of Japan, Vol. 13, page 5) within the following ranges:

$$(220)/(111) \geqq 8\%$$

$$(220)/(200) \geqq 5\%,$$

preferably within the following ranges:

$$(220)/(111) \geqq 50\%$$

$$(220)/(200) \geqq 50\%.$$

The "crystal face having ridgeline at the center of the (110) face" (this crystal face is referred to as semi-(110) face) possessed by the silver halide grains of the present invention is described by referring to the drawings.

Figure 10:
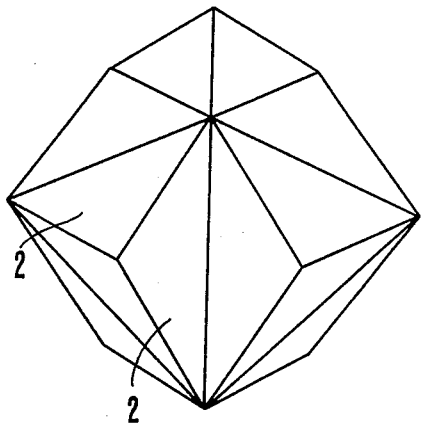
FIGS. 10 to 17 those of silver halide grains having semi-(110) faces of the present invention.

FIG. 10 is an illustration showing one of the whole form of a silver halide grain having semi-(110) face. In FIG. 10, 2 is the semi-(110) face.

Figure 11:
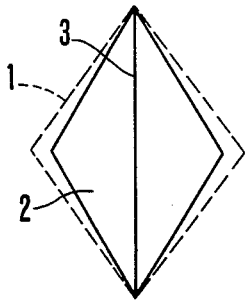
Figure 13:
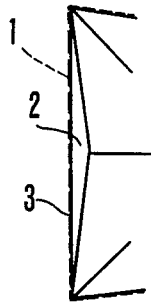
Figure 12:
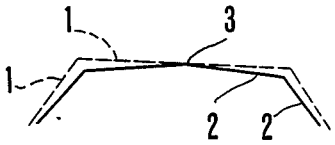
Figure 14:
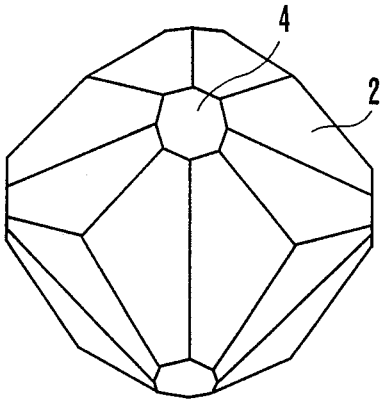
Figure 15:
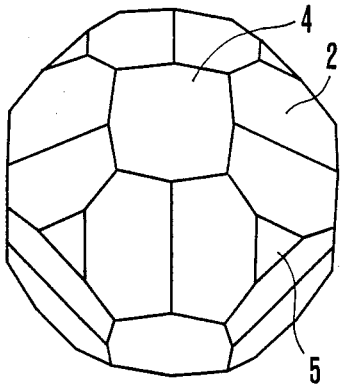
Figure 16:
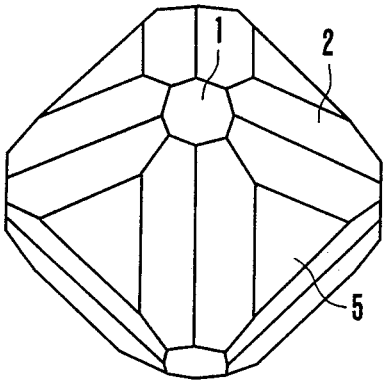
Figure 17:
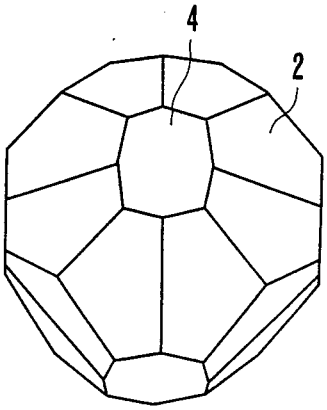
Figure 18:
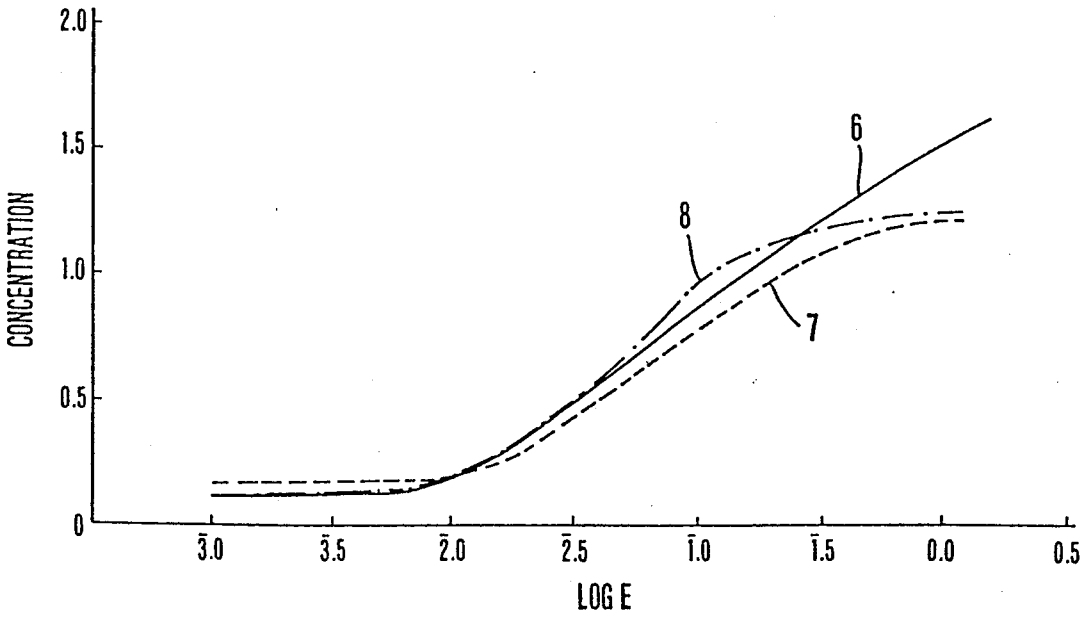

FIG. 11 is a partial plan view of the portion including the (110) face as viewed from the direction perpendicular to the (110) face 1 showing by a broken line, and FIGS. 12 and 13 are front view and side view thereof, respectively. In these Figures, 3 shows the central ridgeline of the (110) face of 1 and 2 the semi-(110) face.

In the silver halide grain according to the present invention, the form of the semi-(110) face is not limited to those as shown in FIGS. 10 to 13, but the angle between the two semi-(110) faces of the roof-type commonly possessed by the ridgeline may be more obtuse than 110°. Examples of these are shown in FIGS. 14 to 17.

The photographic emulsion of the present invention, which employes the host grains of the present invention as described above as the host grains for hybridized silver salt crystals, can give an emulsion with higher sensitivity than the photographic emulsion containing hybridized silver salt crystals using the host grains of the prior art.

While its mechanism is not yet clear, increased sensitivity results probably because of the following reason. That is, due to the special property of the surface of (110) face and semi-(100) face, epitaxial junction will occur at selected sites to be increased in selectivity of epitaxial junction, whereby the epitaxial portions which are the sites for latent image formation are restricted to restrict the latent image forming sites resulting in reduced loss by latent image dispersion.

A dodecahedron has 14 corners, of which 8 corners consist of boundaries of three (110) faces (corner a), with the remaining 6 corners consisting of boundaries of four (110) faces (corner b).

According to the electron microscopic photograph of the present invention, it can be seen that eptiaxial growth has occurred selectively at the corner portions of the dodecahedron crystal, and more selectively on the corner a.

The corner a should microscopically consist of (111) face with minute area, while the corner b of (100) face (although not clearly resolved by the electron microscope). Accordingly, it may be estimated that selectivity for such corners is created through the difference in reactivity between the microscopically existing (100) face and (111) face.

It has been impossible to restrict the reactive site to the specific site through utilization of the difference in reactivity between the minutely existing (100) face and (111) face in the crystal of the prior art consisting only of two kinds of faces of (100) face and (111) face. In the crystal of the prior art, if the surface area of one of the faces is enlarged, the other face will solely be made smaller, with accompaniment in changes in crystal habit and shape. In the emulsion of the present invention, due to the presence of three kinds of faces, the surface areas of (100) face and (111) face can be varied independently of each other, whereby selection of the reactivity which could not be obtained in the crystal of the prior art is rendered possible.

The "epitaxy" as mentioned in the present specification has the same meaning as the term disclosed in Japanese Provisional Patent Publication No. 103,725/1978 (hereinafter called Literature 1) and U.S. Pat. No. 4,142,900 (hereinafter called Literature 2). That is, it means that the crystallographic orientations of silver salt atoms such as silver chloride, silver chlorobromide, silver iodobromide, silver chloroiodobromide, etc. junctioned onto the host grains of silver iodobromide are controlled by the crystals of silver iodobromide or silver bromide as the host grains during growth of these. The epitaxial relationship between the developable epitaxial silver salts such as silver chloride, silver chlorobromide, silver iodobromide, silver chloroiodobromide, etc. and the portion of the silver halide as the host grains of silver iodobromide or silver bromide in the hybridized silver salt crystal is entirely different from the direct physical contact between the crystals such as silver iodide, silver chloride, silver iodobromide, silver chlorobromide, etc.

The host grains in the hybridized silver salt crystals of the present invention are silver halide grains having a silver halide composition consisting substantially of silver iodobromide or silver bromide (such a silver halide composition is hereinafter referred to merely as silver iodobromide). And, as the silver iodobromide grains, there have been known in the prior art poly-dispersed grains comprising the so-called normal crystal grains consisting of (100) faces and (111) faces, namely grains having cubic, octahedral or tetradecahedral shapes or twin crystals.

The normal crystal grains are grains which are primarily mono-dispersed. And, the host silver iodobromide crystals known in the prior art are normal crystals having octahedral, tetradecahedral or cubic shapes consisting of these (100) and/or (111) faces or twin crystal grains.

The host silver iodobromide crystal to be used in the present invention is a crystal having (110) face and/or semi-(110) face, which is a novel product having an entirely different surface from the normal crystal or twin crystal as described above.

The present inventors have discovered that a highly sensitive emulsion can be obtained when the crystal having the novel surface is used as the host crystal for the epitaxial emulsion.

The silver halide grains and the host grains for the hybridized silver salt crystals are silver halide grains having a silver halide composition consisting substantially of silver iodobromide or silver bromide as mentioned above. Here, "consisting substantially of silver iodobromide or silver bromide" means that other silver halides than silver bromide and silver iodide, for example, silver chloride, may be contained within the range which does not interfere with the effect of the present invention. More specifically, in the case of silver chloride, its proportion should desirably be 1 mole % or less.

The proportion of silver iodide in the silver halide grains according to the present invention should preferably be 0 to 20 mole %, more preferably 1 to 15 mole %.

The proportion of silver iodide in the host silver halide grains according to the present invention should preferably be 0 to 40 mole %, and the content of silver iodide should be set at an optimum value depending on the purpose.

More specifically, when it is desired to obtain an optical density by developing most of the host silver halide crystals, it is preferred to use AgI in an amount within the range which does not interfere with developability. Depending on the light-sensitive material to be employed, the optimum AgI content may preferably be 2 to 10 mole % in the case of color negative light-sensitive materials, and 0 to 4 mole % in the case of X-ray light-sensitive materials.

On the other hand, when it is desired to utilize positively the development inhibiting effect of $I^{\ominus}$ contained in the host crystals, for example, when it is intended to improve sharpness of the image through the edge effect or to improve color reproduction through the interimage effect in a multi-layer color light-sensitive material, the content of AgI should be as high as 10 mole % or more, preferably 15 mole % or more, more preferably 30 mole % or more, so that a large amount of $I^-$ may be released.

The upper limit of AgI is not limited for the reason from the viewpoint in use, but the content at which it can exist stably thermodynamically as a solid solution is limited, which is 40 mole % at ordinary emulsion preparation temperatures (20° C.–90° C.).

The silver halide grains according to the present invention should preferably comprise cores having a silver halide composition comprising 3 to 40 mole % of silver iodide and shells for covering over said cores having a silver halide composition comprising 0 to 10 mole % of silver iodide, with the difference in silver iodide content between the shells and cores being 2 to 30 mole %. The silver iodide content at the boundary between the core and the shell may be changed as desired, for example, continuously or stepwise. The core may contain a portion with silver iodide content of 0 as a part thereof (e.g. the portion corresponding to the seed grain in preparation thereof). The shell should desirably have a thickness which does not shield the preferable inherent properties of the core, and yet contrariwise shield the unpreferable inherent properties of the core. Specifically, the above shells in the silver halide grains should have a thickness within the range of from 0.01 to 0.3 μm.

In the silver halide grains according to the present invention, the silver halide composition consisting substantially of silver iodobromide means that other silver halides than silver iodobromide (e.g. silver chloride) may also be contained, provided that the effect of the present invention is not impaired thereby. Specifically, the content of silver halides other than silver iodobromide should desirably be less than 10 mole %.

The grain size of the silver halide grains according to the present invention is not particularly limited, but the present invention is at least effective preferably within the range from 0.1 to 3.0 μm. In the present specification, the grain size of the silver halide refers to the length of one side of the cubic body which is equal to its volume.

The silver halide grains according to the present invention are generally prepared and used in the form dispersed in a dispersing medium such as gelatin, namely the form called as emulsion. The grain size distribution of the group of said grains may be either mono-dispersed or poly-dispersed, and may also be a distribution wherein these are mixed, which can be selected suitably depending on the uses.

In the case of the hybridized silver salt crystals comprising developable silver salt crystals formed through epitaxial junction onto the host grains, a mono-dispersed emulsion is preferred, since epitaxial growth should desirably occur uniformly among respective crystals.

The mono-dispersed emulsion refers to one with a fluctuation coefficient of grain size distribution (percentage of the standard deviation of grain sizes relative to the average grain size) of 20% or less, preferably 15% or less, more preferably 10% or less.

For preparation of the silver halide grains according to the present invention, in the step of forming silver halide grains by mixing a solution of a water-soluble silver salt and a solution of a water-soluble halide in the presence of a protective colloid, the pAg of the emulsion is controlled at 8.0 to 9.5 within a certain period of time, and during this period at least one compound selected from the compounds represented by the formulae (I), (II), (III) or (IV) and the compounds having the recurring units represented by the formula (V) are incorporated in the above emulsion. Among the compounds represented by the formulae (I), (II), (III) and (IV), the compound represented by the formula (I) is more preferred.

In the process for preparation of the silver halide grains according to the present invention, seed grains may be employed and the grains may be grown by forming silver halide on their surfaces. When seed grains are employed, their silver halide composition may be within the scope capable of forming the silver halide grains according to the present invention. The following description through page 25 discloses the preparation of the silver halide grains having semi-(110) faces, namely grains having ridgelines on (110) faces.

The above period of time for controlling pAg may be at any desired point within the term when silver halide can be formed, namely at the initial stage, in the course or at the end of the silver halide formation step. This period should preferably be continuous, but it can also be intermittent within the range which does not interfere with the effect of the present invention. The pAg within this period should preferably be 8.0 to 9.5, more preferably 8.4 to 9.2. And, during this period, the pH of the emulsion should preferably be maintained at 7 to 10. The pAg of the silver halide outside this period of time should appropriately be 4 to 11.5, preferably 6 to 11, and pH appropriately be 2 to 12, preferably 5 to 11.

In the process for preparation of the silver halide grains of the present invention, the step of forming silver halide grains by formation of silver halide should preferably be carried out by adding an aqueous ammoniacal silver nitrate solution and an aqueous halide solution in the presence of ammonia according to the double jet method. Also, it is preferred to add the silver and halide solutions so that no new crystal nucleus may be formed in the process of grain growth.

In the above formulae (I) to (IV), the alkyl group represented by $R_1$ to $R_4$ may include, for example, a methyl group, an ethyl group, a propyl group, a pentyl group, a hexyl group, an octyl group, an isopropyl group, a sec-butyl group, a t-butyl group, a 2-norbornyl and the like; the derivative of alkyl group may include, for example, alkyl groups substituted with an aromatic residue (which may be bonded through a divalent linking group such as —NHCO—, etc.) (e.g. a benzyl group, a phenethyl group, a benzhydryl group, a 1-naphthylmethyl group, a 3-phenylbutyl group, a benzoylaminoethyl group, etc.), alkyl groups substituted with an alkoxy group (e.g. a 2-methoxymethyl group, a 2-methoxyethyl group, a 3-ethoxypropyl group, a 4-butoxybutyl group, etc.), alkyl groups substituted with a halogen atom, a hydroxy group, a carboxy group, a mercapto group, an alkoxycarbonyl group or a substituted or unsubstituted amino group (e.g. a monochloromethyl group, a hydroxymethyl group, a hydroxyethyl group, a 3-hydroxybutyl group, a carboxymethyl group, a 2-carboxyethyl group, a 2-(methoxycarbonyl-)ethyl group, an aminomethyl group, a diethylaminomethyl group, etc.), alkyl groups substituted with a cycloalkyl group (e.g. a cyclopentylmethyl group, etc.), alkyl groups substituted with a monovalent group formed by eliminating one hydrogen atom from the compounds represented by the above formulae (I) to (IV), and so on.

The aryl groups represented by $R_1$ to $R_4$ may include, for example, a phenyl group, a 1-naphthyl group and the like, and the derivative of an aryl group may include, for example, a p-tolyl group, an m-ethylphenyl group, an m-cumenyl group, a mesityl group, a 2,3-xylyl group, a p-chlorophenyl group, an o-bromophenyl group, a p-hydroxyphenyl group, a 1-hydroxy-2-naphthyl group, an m-methoxyphenyl group, a p-ethoxyphenyl group, a p-carboxyphenyl group, an o-(methoxycarbonyl)phenyl group, an m-(ethoxycarbonyl)phenyl group, a 4-carboxy-1-naphthyl group, etc.

The cycloalkyl group represented by $R_1$ to $R_4$ may include, for example, a cycloheptyl group, a cyclopentyl group, a cyclohexyl group, etc. and the derivative of a cycloalkyl group may include, for example, a methylcyclohexyl group, etc. The halogen atom represented by $R_1$ to $R_4$ may be, for example, fluorine, chlorine, bromine and iodine. The derivative of an amino group represented by $R_1$ to $R_4$ may be exemplified by a butylamino group, a diethylamino group, a anilino group, etc. The derivative of a mercapto group represented by $R_1$ to $R_3$ may include, for example, a methylthio group, an ethylthio group, a phenylthio group, etc.

The alklyl group represented by $R_5$ may preferably have 1 to 6 carbon atoms such as a methyl group, an ethyl group, etc.

$R_5$ is particularly preferred to be a hydrogen atom or a methyl group.

J is a divalent linking group, having preferably 1 to 20 total carbon atoms. Of such linking groups, those represented by the formula (J - I) or (J - II) shown below are preferred.

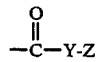
(J-I)

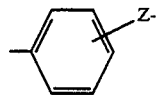
(J-II)

In the above formulae, Y represents —O— or

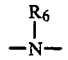

(wherein $R_6$ is a hydrogen atom or an alkyl group having 1 to 6 carbon atoms); and Z represents an alkylene group (having preferably up to 10 carbon atoms, optionally having an intermediary amide linkage, an ester linkage or an ether linkage therein, as exemplified by a methylene group, an ethylene group, a propylene group, $—CH_2OCH_2—$, $—CH_2CONHCH_2—$, $—CH_2CH_2COOCH_2—$, $—CH_2CH_2OCOCH_2—$, $—CH_2NHCOCH_2—$, etc.), —O-alkylene group, —CONH-alkylene group, —COO-alkylene group, —OCO-alkylene group or —NHCO-alkylene group (these alkylene groups having preferably up to 10 carbon atoms) or an arylene group (having preferably 6–12 carbon atoms, such as a p-phenylene group, etc.).

The divalent linking group particularly preferred as J may include the following: —$CONHCH_2$—, —$CONHCH_2CH_2$—, —$CONHCH_2OCOCH_2$—, —$CONHCH_2CH_2CH_2$—$OCOCH_2$—, —$COOCH_2$—, —$COOCH_2CH_2$—, —$COOCH_2CH_2OCOCH_2$—, —$COOCH_2CH_2CH_2OCOCH_2$— and

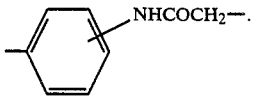

The compound having the units represented by the formula (V) may be either a homopolymer or a copolymer, and the copolymer may include, for example, a copolymer of monomers such as acrylamide, methacrylamide, an acrylate, a methacrylate, etc.

In the following, typical examples of the compounds represented by the above formula (I), (II), (III) or (IV) or the compounds having the recurring units represented by the above formula (V) (hereinafter referred to as tetraazaindene compounds to be used in the present invention) are enumerated.

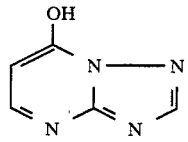

(1)

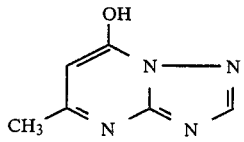

(2)

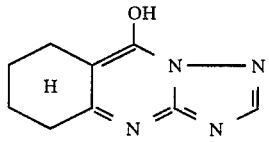

(3)

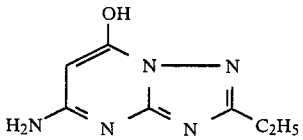

(4)

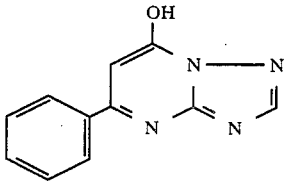

(5)

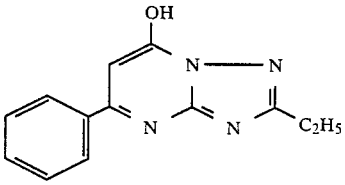

(6)

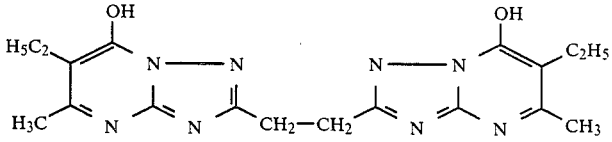

(7)

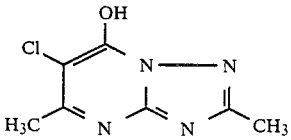

(8)

-continued
(9)
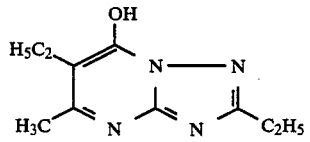
(10)
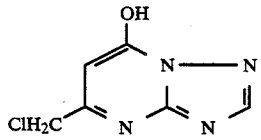
(11)
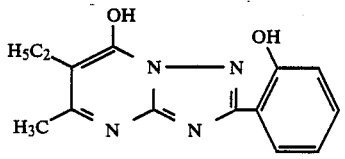
(12)
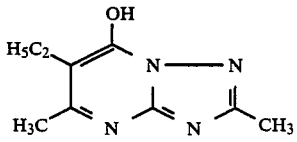
(13)
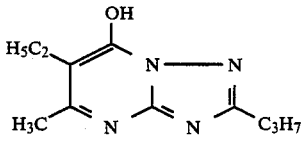
(14)
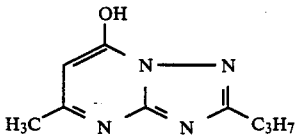
(15)
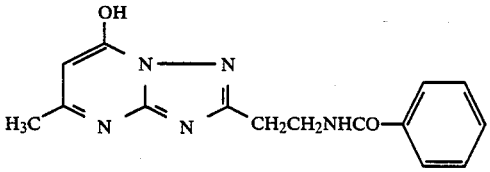
(16)
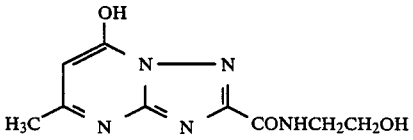
(17)
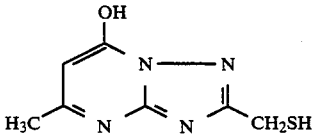
(18)
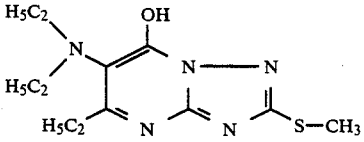

-continued
(19)
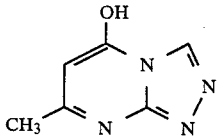
(20)
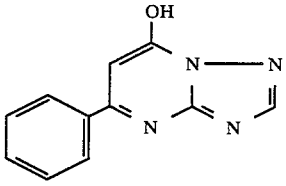
(21)
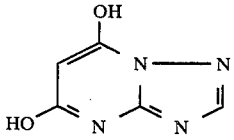
(22)
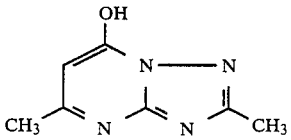
(23)
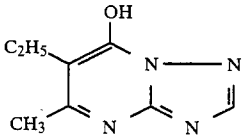
(24)
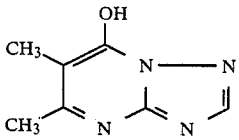
(25)
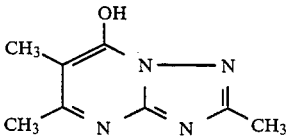
(26)
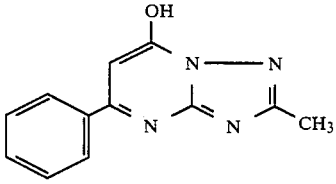
(27)
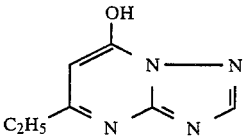
(28)
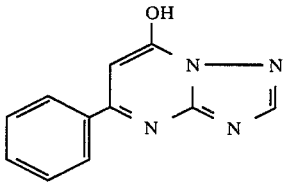

-continued
(29)
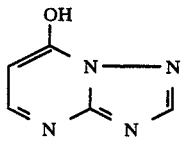
(30)
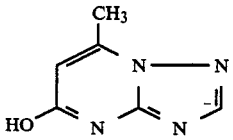
(31)
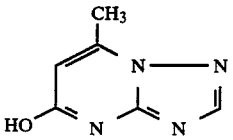
(32)
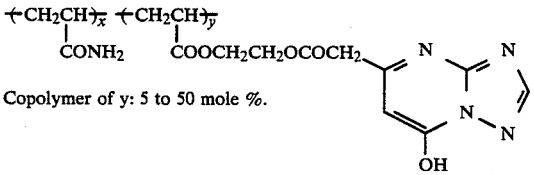
Copolymer of y: 5 to 50 mole %.
(33)
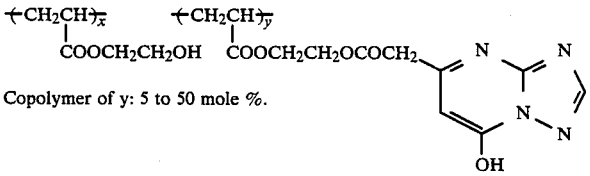
Copolymer of y: 5 to 50 mole %.
(34)
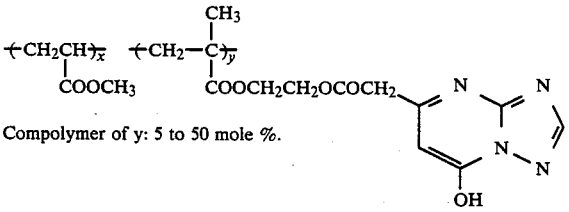
Compolymer of y: 5 to 50 mole %.
(35)
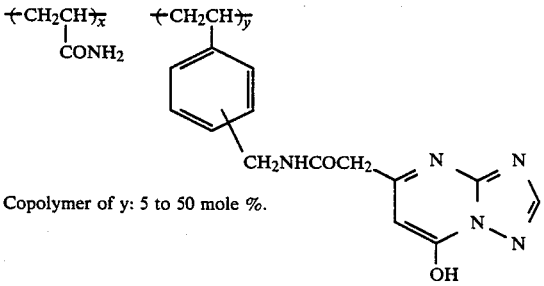
Copolymer of y: 5 to 50 mole %.
(36)
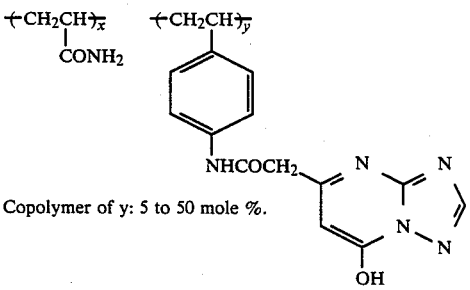
Copolymer of y: 5 to 50 mole %.
The tetraazaindene compound to be used in preparation of the silver halide grains of the present invention When the tetraazaindene compound is a compound having the recurring units represented by the formula (V), the moles of the tetraazaindene moiety is reckoned as the amount added. Further preferable amounts relative to the grain sizes are listed in Table 1. The amounts to be added relative to the grain sizes other than those listed in Table 1 can be determined according to the extrapolation method or the interpolation method from the grain sizes which are inversely proportional to the amounts added.

TABLE 1

| Preferable amounts added relative to desired grain sizes | |
|---|---|
| Grain size (μm) | Preferable amount added (mole/AgX mole) |
| 0.15 | $5.3 \times 10^{-4}$–$5.3 \times 10^{-2}$ |
| 0.3 | $2.7 \times 10^{-4}$–$2.7 \times 10^{-2}$ |
| 0.8 | $1 \times 10^{-4}$–$1 \times 10^{-2}$ |
| 1.5 | $5.3 \times 10^{-5}$–$5.3 \times 10^{-3}$ |
| 3.0 | $2.7 \times 10^{-5}$–$2.7 \times 10^{-3}$ |

Further preferable amounts added relative to pAg and the silver iodide content are as listed in Table 2.

TABLE 2

| Further preferable amounts added relative to respective pAg and AgI content (mol/AgX mol) (desired final grain size: 0.8 μm) | | | |
|---|---|---|---|
| | AgI content | | |
| pAg | 0 | 2% | 20% |
| 9.2 | $2 \times 10^{-4}$–$5 \times 10^{-3}$ | $3 \times 10^{-4}$–$6 \times 10^{-3}$ | $6 \times 10^{-4}$–$1 \times 10^{-2}$ |
| 8.8 | $2 \times 10^{-4}$–$4 \times 10^{-3}$ | $2.5 \times 10^{-4}$–$4 \times 10^{-3}$ | $6 \times 10^{-4}$–$8 \times 10^{-3}$ |
| 8.4 | $1 \times 10^{-4}$–$4 \times 10^{-3}$ | $2 \times 10^{-4}$–$4 \times 10^{-3}$ | $5 \times 10^{-4}$–$6 \times 10^{-3}$ |

The tetraazaindene compound may be added according to the method in which it is previously added in a protective colloid solution, the method in which it is added gradually with the growth of the silver halide grains or a combination of these methods.

In the process for producing silver halide grains of the present invention, seed grains may be used and grains may be grown by forming silver halide on the surfaces thereof. When employing seed grains, their silver halide compositions may be within the range which can form the silver halide grains according to the present invention.

In the silver halide grains of the present invention, a core/shell type is preferred.

The core/shell type silver halide grains can be prepared by covering shells over the silver halide grains thus prepared as the cores. Shells can be formed by depositing a soluble halide solution and a soluble silver salt solution on the cores according to the double jet method.

The methods for preparation of the above core/shell type silver halide grains are disclosed in, for example, West German Pat. No. 1,169,290, British Pat. No. 1,027,146, Japanese Provisional Patent Publication No. 154,232/1982 and Japanese Patent Publication No. 1417/1976.

The silver halide grains of the present invention can be applied with reductive sensitization at any point in the preparation steps.

Reductive sensitization may be performed by stirring the emulsion under low pAg conditions, namely by silver ripening, or by use of a suitable reducing agent such as stannous chloride, dimethylamine borane, hydrazine, thiourea dioxide, etc.

The silver halide grains of the present invention may be applied with doping with various metal salts or metal complexes on formation of silver halide by precipitation, during growth of grains or after completion of growth. For example, there may be applied metal salts or complexes such as of gold, platinum, palladium, iridium, rhodium, bismuth, cadmium, copper, etc. and combinations thereof.

The excessive halides or by-produced or unnecessary salts such as nitrates, ammonium salts, etc. and other compounds may be removed from the dispersing medium for said grains. The method for removal may be the Noodel water washing method, the dialysis method or the coagulation precipitation method conventionally used for emulsions in general.

The silver halide grains of the present invention can also be applied with various chemical sensitizing methods which are applied on emulsions in general. That is, chemical sensitization can be effected with the use of a chemical sensitizer or a combination of chemical sensitizers selected from active gelatin; noble metal sensitizers such as water-soluble gold salts, water-soluble platinum salts, water-soluble palladium salts, water-soluble rhodium salts, water-soluble iridium salts, etc; sulfur sensitizers; selenium sensitizers; reductive sensitizers as mentioned above; etc.

Further, the silver halide grains can be sensitized optically to a desired wavelength region. The method for optical sensitization of the emulsion of the present invention is not particularly limited, but it can be sensitized optically by using either individually or in combination optical sensitizers, for example, cyanine dyes such as zeromethyne dyes, monomethyne dyes, dimethyne dyes, trimethyne dyes, etc. or melocyanine dyes (e.g. ultra-color sensitization). These techniques are also disclosed in U.S. Pat. Nos. 2,688,545, 2,912,329, 3,397,060, 3,615,635 and 3,628,964; British Pat. Nos. 1,195,302, 1,242,588 and 1,293,862, West German OLS Nos. 2,030,326 and 2,121,780; and Japanese Patent Publication Nos. 4936/1968 and 14030/1969. These sensitizers can be chosen as desired depending on the purpose and uses of the light-sensitive material such as the wavelength to be sensitized, sensitivity, etc.

The silver halide grains of the present invention can be provided for use either as such or as a blend of two or more kinds of grains with different average grain sizes, which may be formulated to a desired tone at any time after formation of grains. Otherwise, they can also be used as a mixture with other silver halide grains than those of the present invention.

The hybridized silver salt crystal of the present invention is formed by epitaxial junction of a developable silver salt on such a polyhedron crystal of silver iodobromide. Here, "developable" means that the silver salt can be developed with a known developer for silver halide. Also, the silver salt is a silver salt insoluble in water (including those substantially insoluble in water).

Preferable examples of silver salts for epitaxial junction may include, for example, silver halide crystals such as silver iodobromide, silver bromide, silver chlorobromide, silver chloride and the like, and developable silver salts other than silver halides. For example, as these salts, there may be employed silver thiocyanate, silver cyanate, silver carbonate, silver ferricyanate, silver arsenate, silver arsenite and silver chromate. When the silver salt to be epitaxially junctioned is a silver iodobromide, it is preferred to use a silver halide with lower silver iodide content than the host crystal for epitaxial junction. When the host crystal is silver bromide, the silver halide to be epitaxially junctioned should preferably be silver chlorobromide or silver chloride.

Formation of crystals of silver halides having epitaxially junctioned crystalline structures may be performed according to the following methods.

[A] The method, in which crystals of silver chloride, silver chlorobromide, silver iodobromide, silver chloroiodobromide, etc. are epitaxially junctioned on polyhedral crystals of silver iodobromide according to simultaneous mixing of a solution containing water-soluble halides with a silver salt solution.

[B] The method, in which crystals of silver chloride are epitaxially junctioned onto the polyhedral crystals of silver iodobromide, followed by junction of crystals of silver chlorobromide, silver chloroiodobromide, silver iodobromide, etc. onto the crystals of said silver chloride according to simultaneous mixing of a solution containing water-soluble chloride, water-soluble bromide, water-soluble iodide, etc. with a silver salt solution.

[C] The method, in which crystals such as of silver chlorobromide, silver chloroiodobromide, silver iodobromide, etc. are epitaxially junctioned onto the polyhedral crystals of silver iodobromide according to the conversion method as disclosed in Literature 2.

[D] The method, in which crystals such as of silver chloride, silver chlorobromide, silver iodobromide, silver chloroiodobromide, etc. are epitaxially junctioned by adding a solution containing water-soluble chloride, water-soluble bromide, water-soluble iodide, etc. into a solution containing polyhedral cryatals of silver iodobromide as the host grains, water-soluble silver salt and protective colloid.

In the case of epitaxial crystals having a composition outside the range as specified above, they can be prepared similarly as described above.

In the present invention, at least a half of the polyhedral crystal faces of silver iodobromide of the host crystls are substantially free from epitaxial silver halide, and it is preferred that said epitaxial silver halide is restricted to 75 mole % or less of the hybridized silver halide as a whole.

The epitaxial crystals in the hybridized silver salt crystals in the present invention can be applied with reductive sensitization and doping with a metal salt or complex similarly as the above host grains. It is also possible to remove excessive halides and other unnecessary compounds after formation of epitaxial crystals, similarly as in the case of the above host crystals.

The hybridized silver salt crystal of the present invention can be applied with various chemical sensitization methods generally applied for emulsions in general. That is, it can be subjected to chemical sensitization by using either individually or in combination chemical sensitizers, including active gelatin; noble metal sensitizers such as water-soluble gold salts, water-soluble platinum salts, water-soluble palladium salts, water-soluble rhodium salts, water-soluble iridium salts, etc.; sulfur sensitizers; selenium sensitizers; the reductive sensitizers as described above; and so on.

The photographic emulsion according to the present invention exhibits a preferable interimage effect and edge effect. For example, it is possible to use in the present invention iodide ions released in the developing step for inactivation of the surface of an inhomogeneous catalyst as employed in the redox amplification reaction between, for example, an oxidizing agent (cobalt hexamine, hydrogen peroxide, etc.) and a dye image forming reducing agent (color forming developing agent or redox dye releasing agent, which is used together with an electron transfer agent, etc.).

Also, the photographic emulsion of the present invention can be applied on a suitable support and dried, subjected to imagewise exposure by a radiation with visible spectrum and developed under appropriate developing conditions to give a photographic silver image. Also, even under the redox amplification reaction conditions, the iodide ions released during development can be used as the redox amplification catalyst for inactivation of the silver image.

Further, the photographic emulsion according to the present invention, by containing a dye forming coupler, can give both of silver image and dye image, and yet these images have the advantages of small graininess and grain size.

The photographic emulsion of the present invention is capable of selective developing such as developing of epitaxial silver salt and developing of both epitaxial silver salt and silver iodobromide host grains. Accordingly, the photographic emulsion according to the present invention has the advantages such that it can control the graininess and grain size of the photographic image, that it can control release of iodide ions or that the developing conditions for controlling the maximum density of the image obtained can be selected.

The present invention is to be described in more detail below.

The photographic emulsion according to the present invention contains hybridized crystals of silver iodobromide containing 0 to 40 mole % of silver iodide with the silver salt as mentioned above. The host grain for each hybridized crystal is a crystal of silver iodobromide, and the silver iodobromide crystal as the host grain has the same photosensitivity as the silver iodide crystals as detailed in Literatures 1 and 2, and the silver iodobromide to be used in the present invention should preferably have a minimum grain size of at least 0.2 μm. On the other hand, the second moiety of each hybridized crystal, namely the moiety formed through epitaxial junction on the polyhedron crystal of the above silver iodobromide as the host grain should preferably a crystal of silver halide containing 10 mole % or less of silver iodide such as silver chloride, silver chlorobromide, silver iodobromide, silver choroiodobromide, etc.

The epitaxial hybridized crystal to be used in the present invention acts through the silver iodobromide crystal moiety as the first radiation receptor. Imagewise exposure of a photographic emulsion containing the hybridized crystal of the present invention to blue light will result in formation of a developable latent image. And, exposure of the hybridized crystal can make the whole hybridized crystal developable, but only the epitaxial silver salt crystal moiety can be developed.

The hybridized crystal to be used in the present invention should have no epitaxial silver salt crystal on at least a half of the polyhedral crystal faces of the silver iodobromide, and the epitaxial silver salt crystal is restricted to 75 mole % or less of the whole hybridized silver halide. The epitaxial silver salt crystal, when it reaches 75 mole %, will encroach on the sites of the silver iodobromide crystal faces at which epitaxial growth begins and the adjacent epitaxial crystal structures on the surfaces of the silver iodobromide crystal faces.

The epitaxial silver salt crystal in the hybridized crystal of the present invention is not the first radiation receptor of said hybridized crystal. For this reason, the photographic speed of the photographic emulsion according to the present invention will not be controlled solely by radiation irradiated upon the epitaxial silver salt crystals.

The amount of the epitaxial silver salt crystal in the hybridized crystal should desirably be 1 to 50 mole % of the whole hybridized silver salt crystal, more preferably 5 mole % at its minimum. The epitaxial silver salt has the effect of promoting the initial developing speed. The optimum amount of the epitaxial silver salt of the present invention and its composition can be determined depending on the uses, etc. of the photographic emulsion according to the present invention. For example, when characteristics of high exposure level of radiation and rapid developing speed are required, higher level of the epitaxial salt is employed than in the case of lower exposure level of radiation and slower developing speed. On the other hand, for example, when the storage stability of the silver halide photographic emulsion having the hybridized crystal is considered to be important, an epitaxial silver halide containing silver bromide or silver iodide is used; and when it is used for one bath developing bleach-fixing processing, it is advantageous to control the balance between developing speed, bleaching speed and fixing speed by appropriate selection of the epitaxial silver salt composition.

The epitaxial silver salt can also be controlled by the size of its crystal employed so as to make only said epitaxial silver salt developable without development of the silver iodobromide crystal as the host grain. In this case, the graininess and the grain size of the photographic image will be determined by the limited size (diameter) of the epitaxial silver salt crystal (provided that there is no dissolving physical development). And, the photographic speed is determined by the greater silver iodobromide crystal of the host grain.

The epitaxial silver salt crystal of the present invention makes the hybridized crystal of the present invention reactive for surface developing, so long as no particular change is effected during its formation. In other words, the photographic emulsion according to the present invention can be developed with a surface developer after imagewise exposure. The surface developer can initiate developing of a latent image existing on the surface of the silver halide crystal, and contains substantially no soluble iodide or a silver halide solvent.

The hybridized crystal of the present invention can be formed structurally so that the latent image formed by exposure can exist rather internally of the crystalline structure than on its surface. That is, the epitaxial silver salt crystal in the hybridized crystal of the present invention can be formed as a crystal capable of forming primarily inner latent images. For making inner images readily formable in the hybridized crystal, an inner dopant may be introduced into the epitaxial silver salt crystal. Such inner dopants may include, for example, silver, sulfur, iridium, gold, platinum, osmium, rhodium, tellurium, selenium, etc. The photographic emulsion according to the present invention containing such a hybridized crystal may be developed with an inner developer containing a silver halide solvent or a soluble iodide. In preparation of a hybridized crystal for forming primarily inner latent images, the epitaxial silver salt crystal is placed under the presence of non-silver metal ions, preferably polyvalent metal ions. And, the epitaxial silver salt crystal is formed preferably in the presence of individual water-soluble metal salts, more preferably in an acidic medium. The polyvalent metal ions preferably employed may include divalent metal ions (lead ion, etc.), trivalent metal ions (antimony, bismuth, arsenic, gold, iridium, rhodium ions, etc.) or tetravalent metal ions (iridium ions, etc.). And, preferable polyvalent metal ions are an ion of iridium, bismuth or lead. The epitaxial silver salt crystal may generally contain $10^{-9}$ mole %, preferably $10^{-6}$ mole %, of an inner dopant based on the epitaxial silver salt, and the dopant exists in the epitaxial silver salt crystal at a concentration less than about $10^{-1}$ mole, preferably less than $10^{-4}$ mole, per mole of the epitaxial silver salt.

The hybridized crystal of the present invention comprises epitaxial silver salt crystals formed on the polyhedral crystal faces of silver iodobromide as the host grains according to the methods [A], [B], [C], [D], etc. as described above. Preparation of the silver iodobromide crystals employed as the host grains has already been described above, and typical examples of preparation are also given in the Examples shown below.

The silver halide photographic emulsion according to the present invention can be modified by blending with a different emulsion to obtain desired photographic characteristics. According to this method, it is possible to control photographic sensitivity and contrast. In the photographic emulsion according to the present invention, in the case of the hybridized crystal co-existing with another silver halide crystal blended, the hybridized crystal will participate primarily in image formation, provided that the hybridized crystal of the present invention occupies at least 50% by weight of the total silver halide crystals. Also, even by blending at a level of 50% by weight or less, the interimage effect and the edge effect can effectively be controlled.

In the present invention, silver chloride crystals can be blended with the hybridized crystals of the present invention. The blend with silver chloride crystal has the advantage that the developing speed and/or the silver image density can be substantially intensified by the physical development of the silver chloride crystals, although these crystals are not directly or chemically developable under the conditions set for exposure or developing processing. The blending ratio of the silver chloride crystals to the hybridized silver halide crystals can be chosen as desired depending on the uses. In order to obtain a marked effect by the dissolving physical development, the silver chloride crystals should desirably be blended with the hybridized crystals of the present invention at a level of 1 to 50% by weight, more preferably 5 to 50% by weight, of the total silver halide.

As the binder for the silver halide emulsion according to the present invention or the dispersing medium to be used for preparation of said grains, hydrophilic colloids conventionally used for silver halide emulsions may be employed. The hydrophilic colloid may include not only gelatin (treated with either lime or acid), but also gelatin derivatives, for example, the gelatin derivatives prepared by the reaction between gelatin and aromatic sulfonyl chloride, acid chloride, acid anhydride, isocyanate, 1,4-diketones, etc. as disclosed in U.S. Pat. No. 2,614,928; the gelatin derivatives prepared by the reaction between gelatin and trimellitic acid anhydrides as disclosed in U.S. Pat. No. 3,118,766; the gelatin derivatives prepared by the reaction between organic acids having active halogens and gelatin; the gelatin derivatives prepared by the reaction between organic acids having active halogens and gelatin; the gelatin derivatives prepared by the reaction between aromatic glycidyl ether and gelatin as disclosed in Japanese Patent Publication No. 26845/1967; the gelatin derivatives prepared by the reaction between maleimide, maleamic acid, unsaturated aliphatic diamide, etc. and gelatin as disclosed in U.S. Pat. No. 3,186,846; sulfoalkylated gelatin as disclosed in British Pat. No. 1,033,189; polyoxyalkylene derivatives of gelatin as disclosed in U.S. Pat. No. 3,312,553; polymer-grafted products of gelatin, for example, those having vinyl monomers such as acrylic acid, methacrylic acid, esters thereof with monohydric or polyhydric alcohols, amides thereof, acrylo(or methacrylo)nitrile, styrene and other vinylic monomers either individually or in combination grafted onto gelatin; synthetic hydrophilic polymeric materials, for example, homopolymers or inter-copolymers of monomers such as vinyl alcohol, N-vinyl pyrrolidone, hydroxyalkyl (meth)acrylate, (meth)acrylamide, N-substituted (meth)acrylamide, etc., or copolymers of these monomers with (meth)acrylate, vinyl acetate, styrene, etc., copolymers of any of the above monomers with maleic anhydride, maleamic acid, etc.; natural hydrophilic macromolecular substances other than gelatin such as casein, agar, alginic acid, polysaccharides, etc.

These materials can be used either singly or as a mixture.

The emulsion containing the silver halide grains according to the present invention can contain various additives conventionally used depending on the purposes. These additives may include, for example, stabilizers or antifoggants such as azaindenes, triazoles, tetrazoles, imidazolium salts, tetrazolium salts, polyhydroxy compounds, etc.; film hardeners such as aldehyde type, aziridine type, isoxazole type, vinyl sulfone type, acryloyl type, carbodiimide type, maleimide type, methanesulfonate type, triazine type, etc.; developing acclerators such as benzyl alcohol, polyoxyethylene type compounds; image stabilizers such as couromane type, couramane type, bisphenol type, phosphite ester type, etc.; lubricants such as wax, glycerides of higher fatty acids, etc.; and so on. Also, as the surfactants for coating aids, enhancers of penetrability of processing solutions, defoaming agents or materials for controlling various physical properties, various kinds of anionic, cationic, nonionic and amphoteric surfactants can be used. As the antistatic agents, there may effectively be used diacetyl cellulose, styrene-perfluoroalkylsodium maleate copolymer, alkali salts of the reaction product of styrene-maleic anhydride copolymer and p-aminobenzenesulfonic acid, etc. The matting agent may include polymethyl methacrylate, polystyrene and alkali-soluble polymers. Further, colloidal silicon oxide may also be available. As the latex to be added for improvement of film properties, there may be employed copolymers of acrylate, vinyl ester, etc. with monomers having ethylenic groups. The gelatin plasticizer may be, for example, glycerine and glycolic compounds, and the thickener may include styrene-sodium maleate copolymers, alkyl vinyl ether-maleic acid copolymers, etc.

The silver halide grains according to the present invention may effectively applicable for light-sensitive photographic materials for various uses, such as black-and-white in general, X-ray, color, infrared, microphotography, silver dye bleaching, reversal, diffusion transfer, etc.

The hybridized silver salt crystal according to the present invention is further effectively applicable for light-sensitive photographic materials of various uses such as high contrast photography, photothermography, heat developing sensitive materials, etc.

The emulsion having the silver halide grains of the present invention can have abundant latitude by mixing or coating in multiple layers at least two kinds of emulsions having different average grain sizes and different sensitivites.

The light-sensitive silver halide photographic material according to the present invention has at least one light-sensitive silver halide emulsion layer containing the silver halide grains according to the present invention on a support.

The silver halide grains according to the present invention can be applied for a light-sensitive material for color by employment of the method and the materials conventionally used for light-sensitive materials for color, for example, by incorporating a combination of cyan, magenta and yellow couplers in the emulsions containing the silver halide grains according to the present invention controlled to red-sensitive, green-sensitive and blue-sensitive.

As the yellow coupler, closed ketomethylene type couplers may be employed. Among them, benzoylacetoanilide type and pivaloylacetanilide type compounds are useful. As the magenta coupler, pyrazolone type compounds, indazolone type compounds and cyanoacetyl compounds are useful, while phenol type compounds and naphthol compounds may be available as the cyan coupler.

In the light-sensitive silver halide photographic material, each of the red-sensitive, green-sensitive and blue-sensitive layers may consist of two or more layers. For example, in a light-sensitive color negative photographic material, two or three layers may usually preferably be employed. The positions at which said respective emulsions are provided by coating may be determined as desired depending on the purpose of use. When a plurality of layers of the same color sensitivity are employed, they can be provided as the layers separated from each other.

The emulsion layer containing the silver halide grains according to the present invention may be applicable for any desired layer of these light-sensitive layers. When each light-sensitive layer consists of two or more layers with different sensitivities, the effect of the present invention can be greater when applied for the layer with higher sensitivity than when applied for the layer with lower sensitivity.

As the support for the light-sensitive photographic material, there may be selected one suitably depending on the purpose of use of the respective light-sensitive materials from those conventionally used, such as baryta paper, polyethylene-coated paper, polypropylene synthetic paper, glass, cellulose acetate, cellulose nitrate, polyvinyl acetal, polypropylene, polyester film (e.g. polyethyleneterephthalate), polystyrene and others.

These supports may be applied with subbing treatment, if desired.

The light-sensitive photographic material having the silver halide grains according to the present invention can be developed according to the known method conventionally used after exposure.

The monochromatic developer is an alkali solution containing a developing agent such as hydroxybenzenes, aminophenols, aminobenzenes, etc., which may otherwise contaian sulfites, carbonates, bisulfites, bromides and iodides. When said light-sensitive photographic material is for color, color developing can be carried out according to the color developing method conventionally employed. According to the reversal method, developing is performed first with a monochromatic negative developer, then applied with white exposure or treatment with a bath containing a foggant and further subjected to color developing with an alkali developer containing a color developing agent. The processing method is not particularly limited, but all processing methods may be applicable. Typically, after color developing, bleach-fixing processing is conducted and further, if desired, water washing and stabilizing processing may be performed. Alternatively, after color development, bleaching and fixing are separately conducted, followed further by water washing and stabilizing processing, if desired.

For the developing processing of the light-sensitive photographic material having the silver halide emulsion layer containing the hybridized silver salt crystal according to the present invention, the methods as shown in Literatures 1 and 2 may be appliable. Thus, even the light-sensitive material of the present invention can be physically developed according to the prior art technique and utilized for conventional transfer systems (colloid transfer system, silver salt diffusion transfer system, inhibition transfer system, color transfer system, etc.). For developing only the epitaxial crystals or both of the epitaxial crystals and the silver iodobromide crystals as host grains in the hybridized crystals in the photographic emulsion according to the present invention, it will only suffice to choose a suitable developing agent and further control merely the developing conditions.

When a potent developing agent such as hydroquinone, catechol, phenidone, etc. is used, complete development of the hybridized silver salt crystal can be obtained. Similarly, when a color developing agent such as aminophenol or p-phenylenediamine is used together with a dye forming coupler, substantially complete development of the hybridized silver salt crystal can be obtained. On the other hand, when the color developing agent is used for developing in the absence of a color forming coupler, only the epitaxial crystals are selectively developed. This is because developing is initiated at silver chloride, silver chlorobromide, silver iodobromide, silver chloroiodobromide, silver thiocyanate, etc. At a relatively slow developing speed and without stirring, developing will cease after development of epitaxial crystals has substantially been completed and before initiation of developing of the host silver iodobromide. The amount of the iodide ions released during developing can also be controlled.

The photographic emulsion according to the present invention can suitably be used for the redox amplification system in which an inhomogeneous catalyst enabling the reaction between an oxidizing agent and a reducing agent is required. The oxidizing agents, the reducing agents and details of the system to be used are described in Literatures 1 and 2. Also, as described in the same Literatures, the photographic emulsion according to the present invention is also applicable for heat-sensitive light-sensitive photographic materials.

Also, for the light-sensitive silver halide photographic material utilizing the photographic emulsion containing the hybrid silver halide grains of the present invention, the one bath developing bleach-fixing processing and the color image reinforcing processing as disclosed in, for example, Japanese Provisional Patent Publications Nos. 20025/1977 and 30430/1977, Japanese Provisional Patent Publications Nos. 126,028/1979, 137,332/1979, 161,332/1979 and 161,335/1979 may be used.

The present invention is described in detail by referring to the following Examples, by which the present invention is not limited at all.

EXAMPLE 1

By use of the five kinds of solutions shown below, silver iodobromide emulsions EM - 1 to EM - 3 containing 2.6 mole % of silver iodide were prepared. The seed emulsion was a mono-dispersed silver iodobromide emulsion containing 2 mole % of silver iodide, said emulsion grains having a average grain size of 0.27 μm and a fluctuation coefficient of grain size distribution of 12%.

| (Solution $A_1$ - 1) | |
|---|---|
| Ossein gelatin | 6.92 g |
| Distilled water | 1530 ml |
| Polyisopropylene-polyethyleneoxy-disuccinic acid ester sodium salt 10% ethanolic aqueous solution | 4 ml |
| 4-Hydroxy-6-methyl-1,3,3a,7-tetra-azaindene | amount as shown in Table 3 |
| 28% Aqueous ammonia | 23.2 ml |
| Seed emulsion | amount corresponding to 0.054 mole |
| **(Solution $B_1$ - 1)** | |
| Ossein gelatin | 4.0 g |
| KBr | 157.5 g |
| KI | 6.09 g |
| 4-Hydroxy-6-methyl-1,3,3a,7-tetra-azaindene | amount as shown in Table 3 |
| Distilled water | 337 ml |
| **(Solution $D_1$ - 1)** | |
| $AgNO_3$ | 237.4 g |
| 28% Aqueous ammonia | 193.5 ml |
| Made up to 399.4 ml with addition of distilled water. | |
| **(Solution $E_1$ - 1)** | |
| 50% KBr aqueous solution | amount necessary for pAg adjustment |
| **(Solution $F_1$ - 1)** | |
| 56% Acetic acid solution | amount necessary for pH adjustment |

At 40° C., by means of a mixing stirrer as disclosed in Japanese Provisional Patent Publications Nos. 92523/1982 and 92524/1982, the solution $A_1$ - 1 was mixed with the solution $D_1$ - 1 and the solution $B_1$ - 1 according to the simultaneous mixing method over the minimum time during which no generation of small grains occured. The pAg, pH and the addition rate of the solution $D_1$ - 1 during the simultaneous mixing were controlled as shown in Table 4. The controlling of the pAg and pH were carried out by using a flow rate variable roller tube pump while varing the flow rates of the solution $E_1$ - 1, the solution $F_1$ - 1 and the solution $B_1$ - 1.

Two minutes after completion of the addition of the solution $D_1$ - 1, pAg of the mixture was adjusted to 10.4 with the solution $E_1$ - 1, and further 2 minutes later, adjusted to pH 6.0 with the solution $F_1$ - 1.

TABLE 3

| | Amount of tetraazaindene added | | |
|---|---|---|---|
| | Solution $A_1$ - 1 | Solution $B_1$ - 1 | Total amount |
| EM - 1 | 0 | 0 | 0 |
| EM - 2 | 75 mg | 45 mg | 120 mg |
| EM - 3 | 112 mg | 68 mg | 180 mg |

TABLE 4

| | Conditions of grain growth | | |
|---|---|---|---|
| Time (min) | pAg | pH | Addition rate of solution $D_1$-1 (ml/min) |
| 0 | 8.8 | 9.00 | 1.27 |
| 5.21 | 8.8 | 8.97 | 1.85 |
| 10.55 | 8.8 | 8.94 | 2.74 |
| 15.40 | 8.8 | 8.90 | 3.98 |
| 20.41 | 8.8 | 8.84 | 5.69 |
| 25.32 | 8.8 | 8.76 | 7.53 |
| 30.05 | 8.8 | 8.65 | 9.57 |
| 35.34 | 8.8 | 8.51 | 11.51 |
| 40.17 | 8.8 | 8.36 | 11.86 |
| 45.22 | 8.8 | 8.20 | 12.38 |
| 49.36 | 8.8 | 8.10 | 12.88 |
| 51.85 | 8.8 | 8.00 | 13.13 |

Next, the desalting and washing was carried out in a conventional manner, and the mixture was dispersed in an aqueous solution containing 25.6 g of ossein gelatin and the total amount was adjusted to 600 ml with distilled water. Each of an average grain diameter was found to be 0.8 μm and a fluctuation coefficient of the grain distribution was 11%.

EXAMPLE 2

Silver bromide emulsions EM - 4 and EM - 5 were prepared in the same manner as in Example 1 except that a silver halide composition of the seed grain was changed to silver bromide, the amount of KBr in the solution $B_1$ - 1 was 161.8 g, the amount of KI was 0 and the amount of tetraazaindene was those as shown in Table 5, and the conditions of the grain growth was set as shown in Table 6. Each of the average grain size was found to be 0.8 μm and a fluctuation coefficient of the grain distribution being 10%.

TABLE 5

| | Amount of tetraazaindene added | | |
|---|---|---|---|
| | Solution $A_1$ - 1 | Solution $B_1$ - 1 | Total amount |
| EM - 4 | 20.6 mg | 19.4 mg | 40 mg |
| EM - 5 | 28.4 mg | 51.6 mg | 80 mg |

TABLE 6

| | Conditions of grain growth | | |
|---|---|---|---|
| Time (min) | pAg | pH | Addition rate of solution $D_1$-1 (ml/min) |
| 0.00 | 8.8 | 9.00 | 1.45 |
| 8.84 | 8.8 | 8.94 | 3.11 |
| 13.90 | 8.8 | 8.89 | 4.87 |
| 17.46 | 8.8 | 8.84 | 6.45 |
| 20.30 | 8.8 | 8.79 | 7.78 |
| 24.80 | 8.8 | 8.68 | 10.17 |
| 28.41 | 8.8 | 8.58 | 12.22 |
| 33.16 | 8.8 | 8.42 | 13.31 |
| 36.23 | 8.8 | 8.32 | 13.38 |
| 39.21 | 8.8 | 8.22 | 13.89 |
| 42.06 | 8.8 | 8.11 | 14.37 |

TABLE 6-continued

| | Conditions of grain growth | | |
|---|---|---|---|
| Time (min) | pAg | pH | Addition rate of solution $D_1$-1 (ml/min) |
| 45.22 | 8.8 | 8.00 | 14.81 |

EXAMPLE 3

Silver iodobromide emulsions EM - 6 and EM - 7 were prepared in the same manner as in Example 1 except that the silver halide composition of the seed grain was changed to silver iodobromide containing 15 mole % of silver iodide, the amount of KBr in the solution $B_1$ - 1 was 138.4 g, the amount of KI was 34.77 g and the amount of tetraazaindene was those as shown in Table 7, and the conditions of the grain growth was set as shown in Table 8. Each of the average grain size was found to be 0.8 μm and a fluctuation coefficient of the grain distribution being 13%.

TABLE 7

| | Amount of tetraazaindene added | | |
|---|---|---|---|
| | Solution $A_1$ - 1 | Solution $B_1$ - 1 | Total amount |
| EM - 6 | 25.8 mg | 24.2 mg | 50 mg |
| EM - 7 | 53.3 mg | 96.7 mg | 150 mg |

TABLE 8

| | Conditions of grain growth | | |
|---|---|---|---|
| Time (min) | pAg | pH | Addition rate of solution $D_1$-1 (ml/min) |
| 0.00 | 8.8 | 9.00 | 0.85 |
| 9.24 | 8.8 | 8.97 | 1.33 |
| 15.03 | 8.8 | 8.94 | 1.83 |
| 23.61 | 8.8 | 8.89 | 2.87 |
| 29.66 | 8.8 | 8.84 | 3.80 |
| 34.46 | 8.8 | 8.79 | 4.60 |
| 42.06 | 8.8 | 8.68 | 6.04 |
| 48.12 | 8.8 | 8.58 | 7.29 |
| 53.47 | 8.8 | 8.48 | 7.87 |
| 61.18 | 8.8 | 8.32 | 8.06 |
| 68.50 | 8.8 | 8.16 | 8.57 |
| 76.12 | 8.8 | 8.00 | 9.34 |

The results of X-ray diffractmetries of EM - 1 to EM - 7 are shown in Table 9.

TABLE 9

| | Results of X-ray diffractometry (Relative intensity) | | |
|---|---|---|---|
| Emulsion No. | (220)/(111) | (220)/(200) | Remarks |
| EM - 1 | — | 0 | (200) peaks only |
| EM - 2 | 13.8% | 1.2% | |
| EM - 3 | 78% | 260% | |
| EM - 4 | 3.4% | 0.7% | |
| EM - 5 | 240% | 303% | |
| EM - 6 | 6.1% | 2.7% | |
| EM - 7 | 340% | 213% | |

EXAMPLE 4

Multi-layer color films Samples No. 1 and No. 2 were prepared with the layer constitution as shown in Table 10 below by providing them on a support having a halation preventive layer provided by coating thereon.

In Table 10, B, G and R represent a blue-sensitive layer, a green-sensitive layer and a red-sensitive layer, respectively, H, $H_1$ and $H_2$ high-sensitivity layers, L a low-sensitivity layer, I an intermediate layer, Pr a protective layer and Base a support.

Each amount of the components indicated for respective layers of the sample shows an amount per 1 $m^2$. Further, an amount of the silver halide and colloidal silver were shown as calculated on silver.

TABLE 10

| Sample No. | 1 (Comparative) | 2 (This invention) |
|---|---|---|
| | Pr | Pr |
| | $BH_1$ | $BH_2$ |
| | I | I |
| | GH | GH |
| | I | I |
| | RH | RH |
| | I | I |
| | BL | BL |
| | I | I |
| | GL | GL |
| | I | I |
| | RL | RL |
| | Base | Base |

The respective layers are as follows:

RL

A low-sensitivity red-sensitive emulsion layer containing dispersants prepared by dissolving, in 0.8 g of tricresyl phosphate (TCP), 0.70 g of a red-sensitive color sensitized emulsion (EM - 8) comprising AgBrI containing 2 mole % of AgI and having an average grain diameter (hereinafter referred to as $\gamma$) of 0.40 $\mu$m and a fluctuation coefficient of grain distribution of 18%, 0.7 g of red-sensitive color sensitized emulsion (EM - 9) comprising AgBrI containing 4 mole % of AgI and having an average grain diameter of 0.80 $\mu$m and a fluctuation coefficient of grain distribution of 20%, 1.0 g of 1-hydroxy-4-[$\beta$-(methoxyethyl)aminocarbonyl]methoxy-N-[$\delta$-(2,4-di-t-amylphenoxy)butyl]-2-naphthoamide (C - 1), 0.075 g of 1-hydroxy-8-acetamide-3,6-disulfo-2-naphthylazo)phenoxy]-N-[$\delta$-(2,4-di-t-amylphenoxy)butyl-2-naphthoamido.disodium (CC - 1), 0.01 g of 1-hydroxy-2-[$\delta$-(2,4-di-t-amylphenoxy)-n-butyl]-naphthoamide (C - 2) and 0.07 g of 2-bromo-4-(2,2,3,3,4,4,5,5,6,6,7,7,8,8,9,9-hexadecafluorononanoylamino-7-nitro-2-(1-phenyl-5-tetrazolylthio)-1-indanone (D - 1), and emulsifying them into an aqueous solution containing 2.2 g of gelatin.

RH

A high-sensitivity red-sensitive emulsion layer containing dispersants prepared by dissolving, in 0.3 g of TCP, 1.5 g of a red-sensitive color sensitized silver iodobromide emulsion (EM - 10) comprising AgBrI containing 6 mole % of AgI and having an average grain diameter of 1.50 $\mu$m and a fluctuation coefficient of grain distribution of 40%, 0.26 g of the cyan coupler (C - 1) and 0.03 g of the colored cyan coupler (CC - 1), and emulsifing them into an aqueous solution containing 1.2 g of gelatin.

GL

A low-sensitivity green-sensitive emulsion layer containing dispersants prepared by dissolving, in 0.95 g of TCP, 0.70 g of the EM - 8 sensitized to green-sensitive, 0.70 g of the EM - 9 sensitized to green-sensitive, 0.8 g of 1-(2,4,6-trichlorophenyl)-3-[3-(2,4-di-t-amylphenoxyacetamido)benzamido]-5-pyrazolone (M - 1), 0.15 g of 1-(2,4,6-trichlorophenyl)-4-(1-naphthylazo)-3-(2-chloro-5-octadecenylsuccinimidoanilino)-5-pyrazolone (CM - 1) and 0.012 g of the DIR compound (D - 1), and emulsifying them into an aqueous solution containing 2.2 g of gelatin.

GH

A high-sensitivity green-sensitive emulsion layer containing dispersants prepared by dissolving, in 0.25 g of TCP, 1.6 g of the EM - 10 sensitized to green-sensitive, 0.20 g of the magenta coupler (M - 1) and 0.049 g of the colored magenta coupler (CM - 1), and emulsifying them into an aqueous solution containing 1.9 g of gelatin.

BL

A low-sensitivity blue-sensitive emulsion layer containing dispersants prepared by dissolving, in 0.6 g of TCP, 0.5 g of The EM - 9 sensitized to blue-sensitive and 1.5 g of $\alpha$-pyvalyol-$\alpha$-(1-benzyl-2-phenyl-3,5-dioxoimidazolidine-4-yl)-2'-chloro-5'-[$\alpha$-dodecyloxycarbonyl)ethoxycarbonyl]acetanilide (Y - 1), and emulsifying them into an aqueous solution containing 19 g of gelatin.

$BH_1$

A high-sensitivity blue-sensitive emulsion layer containing dispersants prepared by dissolving, in 0.65 g of TCP, 0.8 g of an octahedral mono-dispersed emulsion (EM - 11) comprising AgBrI containing 6 mole % of AgI and having an average grain diameter of 1.60 $\mu$m and a fluctuation coefficient of grain distribution of 12% applied optimally with gold and sulfur sensitization and also subjected to blue-sensitive sensitization and 0.65 g of the yellow coupler (Y - 1), and emulsifying them into an aqueous solution containing 1.5 g of gelatin.

$BH_2$

A high-sensitivity blue-sensitive emulsion layer which is the same as the above $BH_1$ except for replacing the emulsion (EM - 11) in the above layer $BH_1$ with a dodecahedral mono-dispersed emulsion (EM - 12) comprising AgBrI containing 6 mole % of AgI and having an average grain diameter of 1.60 $\mu$m and a fluctuation coefficient of grain distribution of 12% according to the present invention.

I

An intermediate layer containing 0.8 g of gelatin and dibutylphthalate (DBP) having dissolved therein 0.07 g of 2,5-di-t-octylhydroquinone (HQ - 1).

Pr

A protective gelain layer.

The thus prepared each of Samples No. 1 and No. 2 was carried out a wedge exposure by using a white light and then the following developing processings were carried out.

| Processing steps [Processing temperature: 38° C.] | Processing time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solution used in each of the processing steps are as follows:

| [Color developing solution] | |
|---|---|
| 4-Amino-3-methyl-N-ethyl-N- | 4.75 g |

-continued

| | |
|---|---|
| (β-hydroxyethyl)aniline sulfate | |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Nitrilotriacetic acid.trisodium salt (monohydrate) | 2.5 g |
| Potassium hydroxide | 1.0 g |
| (made up to one liter with addition of water). | |
| [Bleaching solution] | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| (made up to one liter with addition of water and adjusted to pH 6.0 by use of aqueous ammonia). | |
| [Fixing solution] | |
| Ammonium thiosulfate | 175.0 g |
| Anhydrous sodium sulfite | 8.5 g |
| Sodium metasulfite | 2.3 g |
| (made up to one liter with addition of water and adjusted to pH 6.0 by use of acetic acid). | |
| [Stabilizing solution] | |
| Formalin (37% aqueous solution) | 1.5 ml |
| Konidax (produced by Konishiroku Photo Industry Co., Ltd.) | 7.5 ml |
| (made up to one liter with addition of water). | |

The obtained results of an $S_1$ sensitivity, an $S_2$ sensitivity and a fog are shown in Table 11.

In this case, the $S_1$ sensitivity and the $S_2$ sensitivity and fog are shown by the relative value to the Sample No. 1 as the reciprocal of the developing quantity providing $D_{min}+0.1$ and $D_{min}+0.5$ when the minimum concentration is defined as $D_{min}$, respectively.

These values with respect to a blue light (B) are shown in Table 11.

TABLE 11

| Measured light | Characteristic value | No. 1 (Comparative sample) | No. 2 (This invention) |
|---|---|---|---|
| B | $S_1$ sensitivity | 100 | 135 |
| | $S_2$ sensitivity | 100 | 132 |
| | Fog | 0.16 | 0.12 |

As seen from Table 10, it is understood that the light-sensitive photographic material of the present invention has extremely high sensitivity.

EXAMPLE 5

Each EM - 1 (Comparative) and EM - 3 (this invention) was carried out optimally a gold sensitization and color sensitized to the blue color sensitive. Then, 0.8 g of these emulsions were mixed with a dispersion prepared by dissolving, in 0.65 g of TCP, 13.0 g of the yellow coupler (Y - 1) and emulsifying and dispersing in an aqueous solution containing 1.5 g of gelatin, and the mixtures were applied onto the support with a single layer to obtain light-sensitive materials, respectively. These materials were exposed to blue light (B) as in Example 4, and developing processings and measurements were carried out. The resultant $S_1$ sensitivity, $S_2$ sensitivity and fog are shown in Table 12. The calculation manner of the $S_1$ sensitivity and $S_2$ sensitivity are the same as in Example 4.

TABLE 12

| Measured light | Characteristic value | Comparative sample | This invention |
|---|---|---|---|
| B | $S_1$ sensitivity | 100 | 128 |
| | $S_2$ sensitivity | 100 | 125 |
| | Fog | 0.15 | 0.12 |

EXAMPLE 6

The silver halide grains produced in Examples 6, 7 and 8 are grains having semi-(110) faces, namely grains having ridgelines on the (110) faces.

By use of the 5 kinds of solutions, silver bromide emuldions EM - 13 to EM - 15 were prepared. A seed grain was a mono-dispersed silver bromide emulsion and each of the emulsion grain has an average grain diameter of 0.8 μm and a fluctuation coefficient of the grain distribution being 10%.

| (Solution $A_2$ - 1) | |
|---|---|
| Ossein gelatin | 11.90 g |
| Distilled water | 1320 ml |
| Polyisopropylene-polyethyleneoxy-disuccinic acid ester sodium salt 10% ethanolic aqueous solution | 4 ml |
| 4-Hydroxy-6-methyl-1,3,3a,7-tetra-azaindene | amount as shown in Table 13 |
| 28% Aqueous ammonia | 20.8 ml |
| Seed emulsion | amount corresponding to 0.124 mole |
| (Solution $B_2$ - 1) | |
| Ossein gelatin | 3.53 g |
| KBr | 150.2 g |
| 4-Hydroxy-6-methyl-1,3,3a,7-tetra-azaindene | amount as shown in Table 13 |
| Distilled water | 549.7 ml |
| (Solution $D_2$ - 1) | |
| $AgNO_3$ | 218.9 g |
| 28% Aqueous ammonia | 178.6 ml |
| Made up to 613.6 ml with addition of distilled water. | |
| (Solution $E_2$ - 1) | |
| 50% KBr aqueous solution | amount necessary for pAg adjustment |
| (the solution $F_2$ - 1) | |
| 56% Acetic acid solution | amount necessary for pH adjustment |

At 40° C., by means of a mixing stirrer as in Example 1, the solution $A_2$ - 1 was mixed with the solution $D_2$ - 1 and the solution $B_2$ - 1 according to the simultaneous mixing method over minimum time during which no generation of small grains occured. The pAg, pH and the addition rate of the solution $D_2$ - 1 during the simultaneous mixing were controlled as shown in Table 14. The controlling of the pAg and pH were carried out by using a flow rate variable roller tube pump while varing the flow rates of the solution $E_2$ - 1, the solution $F_2$ - 1 and the solution $B_2$ - 1.

Two minutes after from the completion of the addition of the solution $D_2$ - 1, pAg of the mixture was adjusted to 10.4 with the solution $E_2$ - 1, and further 2 minutes later, adjusted to pH 6.0 with the solution $F_2$ - 1.

TABLE 13

| | Amount of tetraazaindene added | | |
|---|---|---|---|
| | Solution $A_2$ - 1 | Solution $B_2$ - 1 | Total amount |
| EM - 13 | 0 | 0 | 0 |
| EM - 14 | 21.3 mg | 38.7 mg | 60 mg |
| EM - 15 | 28.4 mg | 51.6 mg | 80 mg |

TABLE 14

| | Conditions of grain growth | | |
|---|---|---|---|
| Time (min) | pAg | pH | Addition rate of solution $D_2$-1 (ml/min) |
| 0.00 | 8.6 | 9.00 | 2.84 |
| 8.70 | 8.6 | 8.94 | 4.88 |
| 14.60 | 8.6 | 8.89 | 6.52 |
| 19.25 | 8.6 | 8.83 | 7.94 |
| 23.23 | 8.6 | 8.78 | 8.97 |
| 30.02 | 8.6 | 8.67 | 10.86 |
| 35.76 | 8.6 | 8.56 | 12.58 |
| 40.79 | 8.6 | 8.45 | 14.19 |
| 45.29 | 8.6 | 8.34 | 15.70 |
| 49.38 | 8.6 | 8.28 | 17.14 |
| 53.18 | 8.6 | 8.12 | 18.11 |
| 57.50 | 8.6 | 8.00 | 18.60 |

Next, the desalting and washing were carried out in a conventional manner, and the mixture was dispersed in the aqueous solution containing 22.7 g of ossein gelatin and the total amount was adjusted to 600 ml with distilled water.

The average grain diameters of the EM - 13 to EM - 15 were 1.8 μm, respectively. The fluctuation coefficients of the grain distribution were 10% in EM - 13 and 12% in EM - 14 and EM - 15, respectively. The electron microscopic photographs of the silver halide grains in the EM - 13 to EM - 15 are shown in FIGS. 25 to 27, respectively.

EXAMPLE 7

By use of the 5 kinds of solutions and use of conditions as shown in Tables 15 and 16, silver iodobromide emuldions EM - 16 and EM - 17 each having a silver iodide content of 8 mole % were prepared. A seed grain was a mono-dispersed silver iodobromide emulsion having a silver iodide content of 8 mole % and each of the emulsion grain has an average grain diameter of 0.8 μm and a fluctuation coefficient of the grain distribution being 13%.

| | |
|---|---|
| (Solution $A_2$ - 2) | |
| Ossein gelatin | 4.5 g |
| Distilled water | 1360 ml |
| Polyisopropylene-polyethyleneoxy-disuccinic acid ester sodium salt 10% ethanolic aqueous solution | 4 ml |
| 4-Hydroxy-6-methyl-1,3,3a,7-tetra-azaindene | amount as shown in Table 15 |
| 28% Aqueous ammonia | 93.8 ml |
| Seed emulsion | amount corresponding to 0.177 mole |
| (Solution $B_2$ - 2) | |
| Ossein gelatin | 4.0 g |
| KBr | 132.6 g |
| KI | 16.4 g |
| 4-Hydroxy-6-methyl-1,3,3a,7-tetra-azaindene | amount as shown in Table 15 |
| Distilled water | 298.1 ml |
| (Solution $D_2$ - 2) | |
| $AgNO_3$ | 210.0 g |
| 28% Aqueous ammonia | 171.1 ml |

-continued

| | |
|---|---|
| Made up to 353.2 ml with addition of distilled water. | |
| (Solution $E_2$ - 2) | |
| 50% KBr aqueous solution | amount necessary for pAg adjustment |
| (Solution $F_2$ - 2) | |
| 56% Acetic acid solution | necessary amount for pH adjustment |

At 50° C., by means of a mixing stirrer as in Example 1, the solution $A_2$ - 2 was mixed with the solution $D_2$ - 2 and the solution $B_2$ - 2 according to the simultaneous mixing method over minimum time during which no generation of small grains occured. The pAg, pH and the addition rate of the solution $D_2$ - 2 during the simultaneous mixing were controlled as shown in Table 16. The controlling of the pAg and pH were carried out by using a flow rate variable roller tube pump while varing the flow rates of the solution $E_2$ - 2, the solution $F_2$ - 2 and the solution $B_2$ - 2.

Two minutes after from the completion of the addition of the solution $D_2$ - 2, pAg of the mixture was adjusted to 10.4 with the solution $E_2$ - 2, and further 2 minutes later, adjusted to pH 6.0 with the solution $F_2$ - 2.

TABLE 15

| | Amount of tetraazaindene added | | |
|---|---|---|---|
| | Solution $A_2$ - 2 | Solution $B_2$ - 2 | Total amount |
| EM - 16 | 69.3 mg | 30.7 mg | 100 mg |
| EM - 17 | 83.1 mg | 36.9 mg | 120 mg |

TABLE 16

| | Conditions of grain growth | | |
|---|---|---|---|
| Time (min) | pAg | pH | Addition rate of solution $D_2$- 2 (ml/min) |
| 0.00 | 8.6 | 9.00 | 1.42 |
| 17.11 | 8.6 | 9.00 | 1.76 |
| 31.47 | 8.6 | 9.00 | 2.03 |
| 44.22 | 8.6 | 9.00 | 2.24 |
| 55.68 | 8.6 | 9.00 | 2.49 |
| 65.95 | 8.6 | 9.00 | 2.75 |
| 75.31 | 8.6 | 8.85 | 3.00 |
| 83.95 | 8.6 | 8.66 | 3.24 |
| 91.98 | 8.6 | 8.47 | 3.47 |
| 99.51 | 8.6 | 8.28 | 3.68 |
| 106.77 | 8.6 | 8.09 | 3.65 |
| 114.37 | 8.6 | 7.90 | 3.40 |
| 122.78 | 8.6 | 7.71 | 2.91 |
| 127.66 | 8.6 | 7.61 | 2.60 |
| 134.28 | 8.6 | 7.50 | 2.48 |

Next, the desalting and washing was carried out in a conventional manner, and the mixture was dispersed in the aqueous solution containing 25.3 g of ossein gelatin and the total amount was adjusted to 600 ml with distilled water.

Each of the EM - 16 and EM - 17 has an average grain diameter of 1.6 μm and a fluctuation coefficient of the grain distribution were 11%.

EXAMPLE 8

Multi-layer color films Samples No. 3-1 to No. 5-2 were prepared with the layer constitution as shown in Table 17 below by providing them on a support having a halation preventive layer provided by coating thereon.

In Table 17, B, G and R represent a blue-sensitive layer, a green-sensitive layer and a red-sensitive layer, respectively, H, $H_1$ and $H_2$ high-sensitivity layers, L a low-sensitivity layer, I an intermediate layer, Y a yellow filter layer, Pr a protective layer and Base a support.

Each amount of the components indicated for respective layers of the sample shows an amount per 1 $m^2$. Further, the silver halide and colloidal silver were shown as calculated on silver.

TABLE 17

| Sample No. | 3-1 (Comparative) | 3-2 (This invention) | 3-3 (This invention) | 4-1 (Comparative) | 4-2 (This invention) | 5-1 (Comparative) | 5-2 (This invention) |
|---|---|---|---|---|---|---|---|
| | Pr | Pr | Pr | Pr | Pr | Pr | Pr |
| | $BH_1$ | $BH_2$ | $BH_1$ | $BH_1$ | $BH_2$ | $BH_1$ | $BH_2$ |
| | BL | BL | BL | I | I | BL | BL |
| | Y | Y | Y | GH | GH | Y | Y |
| | $GH_1$ | $GH_1$ | $GH_2$ | I | I | GH | GH |
| | GL | GL | GL | RH | RH | I | I |
| | I | I | I | I | I | RH | RH |
| | RH | RH | RH | BL | BL | I | I |
| | RL | RL | RL | I | I | GL | GL |
| | Base | Base | Base | GL | GL | I | I |
| | | | | I | I | RL | RL |
| | | | | RL | RL | Base | Base |
| | | | | Base | Base | | |

The respective layers are as follows:

RL

A low-sensitivity red-sensitive emulsion layer containing dispersants prepared by dissolving, in 0.8 g of TCP, 0.70 g of a red-sensitive color sensitized emulsion (EM - 8') comprising AgBrI containing 2 mole % of AgI and having an average grain diameter of 0.40 μm and a fluctuation coefficient of grain distribution of 18%, 0.7 g of red-sensitive color sensitized emulsion (EM - 9') comprising AgBrI containing 4 mole % of AgI and having an average grain diameter of 0.80 μm and a fluctuation coefficient of grain distribution of 20%, 1.0 g of the cyan coupler (C - 1), 0.075 g of the colored cyan coupler (CC - 1) and 0.07 g of the DIR compound (D - 1), and emulsifying them into an aqueous solution containing 2.2 g of gelatin.

RH

A high-sensitivity red-sensitive emulsion layer containing dispersants prepared by dissolving, in 0.3 g of TCP, 1.5 g of a red-sensitive color sensitized silver iodobromide emulsion (EM - 10') comprising AgBrI containing 6 mole % of AgI and having an average grain diameter of 1.50 μm and a fluctauation coefficient of grain distribution of 40%, 0.26 g of the cyan coupler (C - 1) and 0.03 g of the colored cyan coupler (CC - 1), and emulsifing them into an aqueous solution containing 1.2 g of gelatin.

GL

A low-sensitivity green-sensitive emulsion layer containing dispersants prepared by dissolving, in 0.95 g of TCP, 0.70 g of the EM - 8' sensitized to green-sensitive, 0.70 g of the EM - 9' sensitized to green-sensitive, 0.8 g of the megenta coupler (M - 1), 0.15 g of the colored magenta coupler (CM - 1) and 0.012 g of the DIR compound (D - 1), and emulsifying them into an aqueous solution containing 2.2 g of gelatin.

GH

A high-sensitivity green-sensitive emulsion layer containing dispersants prepared by dissolving, in 0.25 g of TCP, 1.6 g of the EM - 10 sensitized to green-sensitive, 0.20 g of the magenta coupler (M - 1) and 0.049 g of the colored magenta coupler (CM - 1), and emulsifying them into an aqueous solution containing 1.9 g of gelatin.

$GH_1$

A high-sensitivity green-sensitive emulsion layer which is the same as the above GH except for replacing the emulsion (EM - 10') in the layer with an octahedral mono-dispersed emulsion (EM - 18) comprising AgBrI containing 3 mole % of AgI and having an average grain diameter of 1.6 μm and a fluctuation coefficient of grain distribution of 11%.

$GH_2$

A high-sensitivity green-sensitive emulsion layer which is the same as the above GH except for replacing the emulsion (EM - 10') in the layer with a mono-dispersed emulsion (EM - 18) of the present invention comprising AgBrI containing 3 mole % of AgI and having an average grain diameter of 1.6 μm and a fluctuation coefficient of grain distribution of 12% and having a semi-(110) face on the outer surface.

BL

A low-sensitivity blue-sensitive emulsion layer containing dispersants prepared by dissolving, in 0.65 g of TCP, 0.5 g of the EM - 9' sensitized to blue-sensitive and 1.5 g of the yellow coupler (Y - 1), and emulsifying them into an aqueous solution containing 19 g of gelatin.

$BH_1$

A high-sensitivity blue-sensitive emulsion layer containing dispersants prepared by dissolving, in 0.65 g of TCP, 0.8 g of an octahedral mono-dispersed emulsion (EM - 7') comprising AgBrI containing 8 mole % of AgI and having an average grain diameter of 1.60 μm and a fluctuation coefficient of grain distribution of 12% applied optimally with gold and sulfur sensitization and also subjected to blue-sensitive sensitization and 0.65 g of the yellow coupler (Y - 1), and emulsifying them into an aqueous solution containing 1.5 g of gelatin.

$BH_2$

A high-sensitivity blue-sensitive emulsion layer which is the same as the above $BH_1$ except for replacing the emulsion EM - 7' in the above layer with the emulsion EM - 17 according to the present invention.

I

An intermediate layer containing 0.8 g of gelatin and dibutylphthalate (DBP) having dissolved therein 0.07 g of 2,5-di-t-octylhydroquinone (HQ - 1).

Y

A yellow filter layer containing 0.11 g of DBP having dissolved 0.15 g of a yellow colloidal silver and 0.2 g of an anti-contamination agent (HQ - 1), and 1.5 g of gelatin.

Pr

A protective gelain layer.

The thus prepared each of Samples was carried out a wedge exposure by using a white light and then the developing processings were carried out in the same manner as in Example 4.

The results of an $S_1$ sensitivity, an $S_2$ sensitivity and a fog obtained by the multi-layer coated samples are shown in Table 18.

In this case, the $S_1$ sensitivity and the $S_2$ sensitivity are shown by the relative value to the Sample No. 1 as the reciprocal of the developing quantity providing $D_{min}+0.1$ and $D_{min}+0.5$ when the minimum concentration is defined as $D_{min}$, respectively, and the measured values of the samples of the present invention were shown as relative values to those of the comparative sample having the same layer constitution. The result of the fog was also shown in the same manner. Namely, with respect to Sample 3-2 and Sample 3-3, they were shown as relative values to the measured value of Sample 3-1 as 1. In the same manner, the value of Sample 4-2 is a relative value to Sample 4-1 and that of Sample 5-2 is to Sample 5-1.

TABLE 18

| Light measured | Characteristic value Sample No. | $S_1$ sensitivity | $S_2$ sensitivity | Fog |
|---|---|---|---|---|
| B | 3-2 | 1.31 | 1.28 | 0.79 |
| | 4-2 | 1.30 | 1.26 | 0.82 |
| | 5-2 | 1.25 | 1.25 | 0.80 |
| G | 3-3 | 1.29 | 1.27 | 0.81 |

As seen from Table 18, it is understood that the light-sensitive photographic materials of the present invention are extremely excellent in the relation of sensitivity-fog.

EXAMPLE 9

By use of the 5 kinds of solutions, host silver iodobromide emulsions EM - 1H to EM - 4H were prepared. A seed grain was a mono-dispersed silver iodobromide containing 2 mole % of silver iodide, and each of the emulsion grain has an average grain size of 0.27 μm and a fluctuation coefficient of the grain distribution being 10%.

| | |
|---|---|
| (Solution $A_3$ - 1) | |
| Ossein gelatin | 6.92 g |
| Distilled water | 1530 ml |
| Polyisopropylene-polyethyleneoxy-disuccinic acid ester sodium salt 10% ethanolic aqueous solution | 4 ml |
| 4-Hydroxy-6-methyl-1,3,3a,7-tetra-azaindene | amount as shown in Table 19 |
| 28% Aqueous ammonia | 23.2 ml |
| Seed emulsion | amount corresponding to 0.054 mole |
| (Solution $B_3$ - 1) | |
| Ossein gelatin | 4.0 g |
| KBr | amount as shown in Table 20 |
| KI | amount as shown in Table 20 |
| 4-Hydroxy-6-methyl-1,3,3a,7-tetra-azaindene | amount as shown in Table 19 |
| Distilled water | 337 ml |
| (Solution $D_3$ - 1) | |
| The same as the solution $D_1$ - 1 used in Example 1. | |
| (Solution $E_3$ - 1) | |
| 50% KBr aqueous solution | amount necessary for pAg adjustment |
| (Solution $F_3$ - 1) | |
| 56% Acetic acid solution | amount necessary for pH adjustment |

At 40° C., by means of a mixing stirrer as shown in Example 1, the solution $A_3$ - 1 was mixed with the solution $D_3$ - 1 and the solution $B_3$ - 1 according to the simultaneous mixing method over minimum time during which no generation of small grains occured. The pAg, pH and the addition rate of the solution $D_3$ - 1 during the simultaneous mixing were controlled as shown in Tables 21 to 24. The controlling of the pAg and pH were carried out by using a flow rate variable roller tube pump while varing the flow rates of the solution $E_3$ - 1, the solution $F_3$ - 1 and the solution $B_3$ - 1.

Two minutes after of the completion of the addition of the solution $D_3$ - 1, pAg of the mixture was adjusted to 10.4 with the solution $E_3$ - 1, and further 2 minutes later, adjusted to pH 6.0 with the solution $F_3$ - 1.

Next, the desalting and washing was carried out in a conventional manner, and the mixture was dispersed in the aqueous solution containing 25.6 g of ossein gelatin and the total amount was adjusted to 600 ml with distilled water

TABLE 19

| Emulsion No. | Amount of tetraazaindene added: Solution $A_3$ - 1 | Solution $B_3$ - 1 | Total amount |
|---|---|---|---|
| EM - 1H | 113 mg | 68 mg | 180 mg |
| EM - 2H | 89 mg | 1110 mg | 1199 mg |
| EM - 3H | 112 mg | 68 mg | 180 mg |
| EM - 4H | 89 mg | 1110 mg | 1199 mg |

| Emulsion No. | Amount of KBr and KI in Solution $B_3$ - 1 added: Iodine content of the host silver iodobromide crystal | KBr | KI | Remarks |
|---|---|---|---|---|
| EM - 1H | 30 mole % | 101 g | 70.3 g | This invention |
| EM - 2H | 30 mole % | 101 g | 70.3 g | Other than this invention |
| EM - 3H | 8 mole % | 136 g | 18.75 g | This invention |
| EM -4H | 8 mole % | 136 g | 18.75 g | Other than this invention |

TABLE 21

Grain growth conditions of EM-1H

| Time (min) | pAg | pH |
|---|---|---|
| 0 | 8.60 | 9.00 |
| 5.90 | 8.60 | 8.98 |
| 10.79 | 8.60 | 8.97 |
| 21.81 | 8.60 | 8.94 |
| 32.02 | 8.60 | 8.90 |
| 41.57 | 8.60 | 8.85 |
| 50.67 | 8.60 | 8.79 |
| 60.75 | 8.60 | 8.70 |
| 70.29 | 8.60 | 8.61 |
| 80.37 | 8.60 | 8.50 |
| 90.67 | 8.60 | 8.37 |
| 100.54 | 8.60 | 8.25 |
| 109.56 | 8.60 | 8.12 |
| 117.84 | 8.60 | 8.00 |

TABLE 22

Grain growth conditions of EM-2H

| Time (min) | pAg | pH |
|---|---|---|
| 0 | 9.00 | 9.00 |
| 28.80 | 9.03 | 8.95 |
| 43.77 | 9.07 | 8.91 |
| 58.77 | 9.11 | 8.85 |
| 73.74 | 9.17 | 8.78 |
| 88.71 | 9.24 | 8.69 |
| 103.7 | 9.33 | 8.57 |
| 118.68 | 9.43 | 8.45 |
| 133.65 | 9.54 | 8.32 |
| 148.65 | 9.63 | 8.20 |
| 163.62 | 9.73 | 8.08 |
| 175.72 | 9.79 | 8.00 |

TABLE 23

| Grain growth conditions of EM-3H | | |
|---|---|---|
| Time (min) | pAg | pH |
| 0 | 8.8 | 9.00 |
| 5.21 | 8.8 | 8.97 |
| 10.55 | 8.8 | 8.94 |
| 15.40 | 8.8 | 8.90 |
| 20.41 | 8.8 | 8.84 |
| 25.32 | 8.8 | 8.76 |
| 30.05 | 8.8 | 8.65 |
| 35.34 | 8.8 | 8.51 |
| 40.17 | 8.8 | 8.36 |
| 45.22 | 8.8 | 8.20 |
| 49.36 | 8.8 | 8.10 |
| 51.85 | 8.8 | 8.00 |

TABLE 24

| Grain growth conditions of EM-4H | | |
|---|---|---|
| Time (min) | pAg | pH |
| 0 | 9.00 | 9.00 |
| 12.52 | 9.03 | 8.95 |
| 19.03 | 9.07 | 8.91 |
| 25.55 | 9.11 | 8.85 |
| 32.06 | 9.17 | 8.78 |
| 38.57 | 9.24 | 8.69 |
| 45.09 | 9.33 | 8.57 |
| 51.60 | 9.43 | 8.45 |
| 58.11 | 9.54 | 8.32 |
| 64.63 | 9.63 | 8.20 |
| 71.14 | 9.73 | 8.08 |
| 76.40 | 9.79 | 8.00 |

The results of the electron microscopic photographs' observation were shown in Table 25.

TABLE 25

| Emulsion No. | Shape | Width of grain distribution (Fluctuation coefficient)* | Remarks |
|---|---|---|---|
| EM - 1H | dodeca-hedral | 11.8 | This invention |
| EM - 2H | octa-hedral | 13.4 | Other than this invention |
| EM - 3H | dodeca-hedral | 9.5 | This invention |
| EM - 4H | octa-hedral | 10.8 | Other than this invention |

$$\text{*Fluctuation coefficient} = \frac{\text{Standard deviation of grain diameter}}{\text{Average grain diameter}} \times 100\ (\%)$$

EXAMPLE 10

By use of the three kinds of solutions as shown in Table 26, emulsions of which pure silver halide was epitaxialy grown on the silver iodobromide used in Example 9 were prepared.

| | |
|---|---|
| (Solution $A_3$ - 2) | 0.5 mole aqueous solution of $AgNO_3$ |
| (Solution $B_3$ - 2) | 0.5 mole aqueous solution of KCl |
| (Solution $C_3$ - 2) | |
| Ossein gelatin | 4.4 g |
| KCl | 1.0 g |
| Any of EM-1H to EM-4H | 135 ml |
| Distilled water | 840 ml |

At 35° C., to the solution $C_3$ - 2 were simultaneously added, 27 ml of the solution $A_3$ - 2 and 27 ml of the solution $B_3$ - 2 over 10 minutes by using the double jet method. After completion of the addition, washing and desalting were carried out according to the following procedures. To the solution were added a 5% aqueous solution of Demol N (trade name, produced by Kao Atlas K. K.) and a 20% aqueous solution of magnesium sulfate in the ratio of 10:9 as precipitants until precipitates were generated. After the precipitates were sedimented by left to stand and the supernatent was removed by decantation, 800 ml of distilled water was added thereto to disperse again. Then, a 20% aqueous solution of magnesium sulfate was further added thereto until precipitates were regenerated. After the precipitates were sedimented, the supernatant was removed by decantation. An aqueous solution of osein gelatin containing 10 g of gelatin was added to the precipitates, and the mixtrue was stirred at 35° C. for 20 minutes to obtain dispersion and was added distilled water to adjust the total amount thereof to 150 ml.

Hereinafter referred to these emulsions as EM - 1E to EM - 4E, respectively.

EXAMPLE 11

A mono-dispersed silver iodide emulsion was prepared by using the following three kinds of the solutions.

| | |
|---|---|
| (Solution $A_3$ - 3) | |
| Ossein gelatin | 100.0 g |
| Distilled water | 3.0 l |
| KI | 2.23 g |
| Temperature | 35° C. |
| pH | 6.0 |
| (Solution $B_3$ - 3) | |
| 5 mole % aqueous solution of KI | 1000 ml |
| (Solution $C_3$ - 3) | |
| 5 mole % aqueous solution of $AgNO_3$ | 800 ml |

To the solution $A_3$ - 3 were dipped a commercially available iodine ion electrode and a double junction type silver/silver chloride referencial electrode (junction solution: a 1 mole % aqueous solution of $KNO_3$), and a potential of the solution was measured. To the above solution were added the solutions $B_3$ - 3 and $C_3$ - 3 while keeping the potential (−175 mV) thereof during the addition of the solutions by controlling the flow rate of the solution $B_3$ - 3.

The addition rate of the solution $C_3$ - 3 was set to as 0.5 ml/min for 6 minutes from the start of the addition and thereafter linearly increased in the ratio of 0.385 ml/min per 10 minutes. It was required to add the whole the solution $C_3$ - 3 thereto for 197 minutes and the temperature during the physical ripening was kept to 35° C. The addition was ceased at which all the solution $C_3$ - 3 had been added thereto, and washing and desalting were carried out according to the following procedures.

To the solution were added a 5% aqueous solution of Demol N (trade name, produced by Kao Atlas K. K.) and a 20% aqueous solution of magnesium sulfate in the ratio of 10:9 as precipitants until precipitates were generated. After the precipitates were sedimented by left to stand and the supernatent was removed by decantation, 3000 ml of distilled water was added thereto to disperse again. Then, a 20% aqueous solution of magnesium sulfate was further added thereto until precipitates were regenerated. After the precipitates were sedimented, the supernatant was removed by decantation. An aqueous solution of ossein gelatin containing 56.6 g of gelatin was added to the precipitates, and the mixtrue was stirred at 35° C. for 20 minutes to obtain dispersion and was added distilled water to adjust the total amount thereof to 1703 ml. This emulsion was referred to as EM - 5H. It was found that this EM - 5H emulsion has an average grain diameter of 0.25 μm and a standard deviation of the grain being 20% of the average grain diameter by the electron microscopic photograph thereof. Further, it was found that this EM - 5H emulsion was composed of a β-phase silver iodide containing little amount of α-phase or γ-phase thereof.

EXAMPLE 12

In the same manner as in Example 10, an emulsion EM - 5E of which silver chloride was epitaxially juncted to the silver iodide host emulsion EM - 5H was prepared.

EXAMPLE 13

To each of silver halide emulsions EM - 1E, EM - 2E, EM - 3E, EM - 4E and EM - 5E were added, per mole of silver, $2.0\times10^{-8}$ mole of hypo and $1.0\times10^{-8}$ mole of sodium salt of chloroauric acid, and the mixture was stirred at 45° C. for 60 minutes. Subsequently, to the mixture were added 4-hydroxy-6-methyl-1,3,3a,7-tetrazaindene and 1-phenyl-5-mercaptotetrazole, and, before coating, were added bis(vinylsulfonylmethyl)ether and saponin. The mixture was coated on a support so as to contain 3.0 g/m$^2$ of silver and 2.0 g/m$^2$ of gelatin to form samples (Samples No. 1 to No. 10). These samples were subjected to a white exposure through a light wedge by using KS - 1 Type Photosensitometer (produced by Konishiroku Photo Industry Co., Ltd.), and processed by using the following developing solution at 20° C. for 10 minutes. The results are shown in Table 26.

| [Composition of the developing solution] | |
|---|---|
| Metol | 6 g |
| Anhydrous sodium sulfite | 50 g |
| Hydroquinone | 6 g |
| Sodium carbonate | 29.5 g |
| Potassium bromide | 1.0 g |
| Adjusted to 1 with the addition of water | |

TABLE 26

| Sample No. | Emulsion No. | Relative sensitivity | gamma | $D_{min}$ | $D_{max}$ | Remarks |
|---|---|---|---|---|---|---|
| 6 | EM-1H | No | No | 0.03 | 0.08 | 30 mole % AgBrI (110) host of this invention |
| 7 | EM-2H | No | No | 0.03 | 0.08 | 30 mole % AgBrI (111) other than this invention |
| 8 | EM-3H | No | No | 0.03 | 0.24 | 8 mole % AgBrI (110) host of this invention |
| 9 | EM-4H | No | No | 0.03 | 0.21 | 8 mole % AgBrI (111) other than this invention |
| 10 | EM-5H | No | No | 0.03 | 0.05 | pure AgI, other than this invention |
| 11 | EM-1E | 114 | 0.65 | 0.03 | 1.10 | 30 mole % AgBrI (110) + AgCl epitaxial, this invention |
| 12 | EM-2E | 80 | 0.54 | 0.03 | 1.05 | 30 mole % AgBrI (111) + AgCl epitaxial other than this invention |
| 13 | EM-3E | 125 | 0.85 | 0.04 | 1.45 | 8 mole % AgBrI (110) + AgCl epitaxial, this invention |
| 14 | EM-4E | 100 | 0.71 | 0.04 | 1.31 | 8 mole % AgBrI (111) + AgCl epitaxial, other than this invention |
| 15 | EM-5E | 60 | 0.25 | 0.03 | 0.42 | pure AgI + AgCl epitaxial, other than this invention |

As seen from Table 26, it was found that the epitaxial emulsions of the present invention has excellent developability (high in $D_{max}$ and gamma) and excellent photosensitivity (high in sensitivity).

EXAMPLE 14

After emulsions EM - 1E, EM - 2E, EM - 3E and EM - 4E were chemical sensitized in the same manner as in Example 13, they were spectrally sensitized by adding $3.0\times10^{-4}$ mole of the following sensitizing dye (I) per mole of silver and $3.5\times10^{-4}$ mole of the following sensitizing dye (II) per mole of silver.

Sensitizing dye (I):

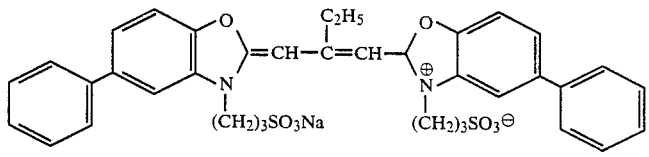

Sensitizing dye (II):

-continued

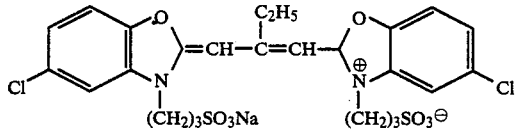

Then, to the mixture were added 4-hydroxy-6-methyl-1,3,3a,7-tetrazaindene and 1-phenyl-5-mercaptoetrazol, and thereafter were further added, after emulsified, 60 g of tricresyl phosphate having dissolved therein 50 g of 1-(2,4,6-trichlorophenyl)-3-[3-(2,4-di-t-amylphenoxyacetamido)benzamido]-5-pyrazolone, 10 g of 1-(2,4,6-trichlorophenyl)-4-(1-naphthylazo)-3-(2-chloro-5-octadecenylsuccinimidoanilino)-5-pyrazolone and 1.5 g of 2-(1-phenyl-5-tetrazolylthio)-4-octadecylsuccinimido-1-indanone. Then, on a support comprising transparent cellulose triacetate base which was subbing treated was coated the above mixture to be contained 2.0 g/m$^2$ of silver. Thereafter, these samples were subjected to the wedge exposure in the same manner as in Example 13 through a yellow filter and then carried out the following developing processings.

| [Developing processing] | |
|---|---|
| Processing steps (37.8° C.) | Processing time |
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solution used in each of the processing steps are as follows:

| [Color developing solution] | |
|---|---|
| 4-Amino-3-methyl-N-ethyl-N-(β-hydroxyethyl)aniline sulfate | 4.8 g |
| Anhydrous sodium sulfite | 0.14 g |
| Hydroxylamine ½ sulfate | 1.98 g |
| Sulfric acid | 0.74 g |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Nitrilotriacetic acid.trisodium salt (monohydrate) | 1.20 g |
| Potassium hydroxide | 1.48 g |
| (made up to one liter with addition of water). | |

[Bleaching solution]
The same as in Example 4.

| [Fixing solution] | |
|---|---|
| Ammonium thiosulfate | 175.0 g |
| Anhydrous sodium sulfite | 8.6 g |
| Sodium metasulfite | 2.3 g |
| (made up to one liter with addition of water and adjusted to pH 6.0 by use of acetic acid). | |

[Stabilizing solution]
The same as in Example 4.
The results are shown in Table 27.

TABLE 27

| Sample No. | Emulsion No. | Fog | Relative sensitivity | $D_{max}$ | Remarks |
|---|---|---|---|---|---|
| 16 | EM-1E | 0.06 | 130 | 1.35 | This invention, 30 mole % AgBrI (110) + AgCl epitaxial |
| 17 | EM-2E | 0.06 | 100* | 1.35 | Other than this invention (Comparative), 30 mole % AgBrI (111) + AgCl epitaxial |
| 18 | EM-3E | 0.07 | 125 | 1.91 | This invention, 8 mole % AgBrI (110) + AgCl epitaxial |
| 19 | EM-4E | 0.07 | 100* | 1.84 | Other than this invention (Comparative), 8 mole % AgBrI (111) + AgCl epitaxial |

*Relative sensitivities were shown the sensitivity of Comparative samples as 100.

As can be seen from the results in Table 27, the epitaxial emulsions of the present invention which employ a host crystal having (110) face have high sensitivities than the conventional epitaxial emulsions which employ a host crystal having (111) face and also the former is useful in color photographics.

EXAMPLE 15

By use of the seven kinds of solutions shown below, core/shell type silver iodobromide emulsions EM - 21 and EM - 22 each containing silver iodide content of 15 mole %, 5 mole % and 0.3 mole % from the inner portion of a grain in the order, respectively, were prepared. A seed grain was a mono-dispersed silver iodobromide emulsion containing 2.6 mole % of silver iodide and each of the emulsion grains has an average grain diameter of 0.8 μm and a fluctuation coefficient of the grain distribution of 11%.

In the above, the fluctuation coefficient means a parameter showing monodispersibility of the grain and can be defined as follows:

$$\text{Fluctuation coefficient} = \frac{\text{Standard deviation of grain diameter}}{\text{Average grain diameter}} \times 100(\%)$$

| (Solution A4-1) | |
|---|---|
| Ossein gelatin | 22.5 g |
| Distilled water | 6799 ml |
| Polyisopropylene-polyethyleneoxy-disuccinic acid ester sodium salt 10% ethanol aqueous solution | 20 ml |
| 4-Hydroxy-6-methyl-1,3,3a,7-tetra-azaindene | amount as shown in Table 28 |

-continued

| | |
|---|---|
| 28% Aqueous ammonia | 469 ml |
| Seed grain | amount corresponding to 0.8828 mole |
| (Solution $B_4$-1) | |
| Ossein gelatin | 6.0 g |
| KBr | 212 g |
| KI | 52.3 g |
| 4-Hydroxy-6-methyl-1,3,3a,7-tetra-azaindene | amount as shown in Table 28 |
| Distilled water | 50 ml |
| (Solution $C_4$-1) | |
| Ossein gelatin | 5.0 g |
| KBr | 198 g |
| KI | 14.5 g |
| 4-Hydroxy-6-methyl-1,3,3a,7-tetra-azaindene | amount as shown in Table 28 |
| Distilled water | 422 ml |
| (Solution $D_4$-1) | |
| Ossein gelatin | 20 g |
| KBr | 830 g |
| KI | 3.5 g |
| 4-Hydroxy-6-methyl-1,3,3a,7-tetra-azaindene | amount as shown in Table 28 |
| Distilled water | 1672 ml |
| (Solution $E_4$-1) | |
| $AgNO_3$ | 1109 g |
| 28% Aqueous ammonia | 904 ml |
| Made up to 1866 ml with addition of distilled water. | |
| (Solution $F_4$-1) | |
| 50% KBr aqueous solution | amount necessary for pAg adjustment |
| (Solution $G_4$-1) | |
| 56% Acetic acid solution | amount necessary for pH adjustment |

TABLE 28

| | Amount of tetraazaindene added | | | |
|---|---|---|---|---|
| Emulsion | Solution $A_4$-1 | Solution $B_4$-1 | Solution $C_4$-1 | Solution $D_4$-1 |
| EM-21 | 277 mg | 42 mg | 35 mg | 139 mg |
| EM-22 | 415 mg | 63 mg | 52 mg | 209 mg |

At 50° C., by means of a mixing stirrer as in Example 1, the solution $A_4$ - 1 was mixed with the solution $E_4$ - 1 and the solution $B_4$ - 1 according to the simultaneous mixing method, the solution $G_4$ - 1 was added thereto at which the same time with the addition completion of the solution $B_4$ - 1, and the solution $D_4$ - 1 was added thereto at which the same time with the addition completion of the solution $C_4$ - 1. The pAg, pH and the addition rate of the solution $E_4$ - 1 during the simultaneous mixing were controlled as shown in Table 29. The controlling of the pAg and pH were carried out by using a flow rate variable roller tube pump while varing the flow rates of the solution $F_4$ - 1 and the solution $G_4$ - 1.

Two minutes after from the completion of the addition of the solution $E_4$ - 1, pAg of the mixture was adjusted to 10.4 with the solution $F_4$ - 1, and further 2 minutes later, adjusted to pH 6.0 with the solution $G_4$ - 1.

TABLE 29

| | | | Addition speed of solution (ml/min) | | | |
|---|---|---|---|---|---|---|
| Time (min) | pAg | pH | Solution $E_4$-1 | Solution $B_4$-1 | Solution $C_4$-1 | Solution $D_4$-1 |
| 0.00 | 8.6 | 9.00 | 7.09 | 7.09 | | |
| 10.59 | 8.6 | 9.00 | 8.17 | 8.17 | | |
| 21.05 | 8.6 | 9.00 | 9.20 | 9.20 | | |
| 30.49 | 8.6 | 9.00 | 10.07 | 10.07 | | |

TABLE 29-continued

| | | | Addition speed of solution (ml/min) | | | |
|---|---|---|---|---|---|---|
| Time (min) | pAg | pH | Solution $E_4$-1 | Solution $B_4$-1 | Solution $C_4$-1 | Solution $D_4$-1 |
| 40.13 | 8.6 | 9.00 | 10.89 | 10.89 | | |
| 46.47 | 8.6 | 9.00 | 11.40 | 11.40 | 11.40 | |
| 50.54 | 8.6 | 9.00 | 13.45 | | 13.45 | |
| 56.99 | 8.6 | 9.00 | 22.23 | | 22.23 | 22.23 |
| 60.03 | 8.6 | 9.00 | 40.79 | | | 40.79 |
| 65.04 | 8.6 | 8.65 | 56.83 | | | 56.83 |
| 70.14 | 8.6 | 8.21 | 65.76 | | | 65.76 |
| 75.05 | 8.6 | 7.78 | 55.19 | | | 55.19 |
| 79.38 | 8.6 | 7.50 | 39.79 | | | 39.79 |

Next, by use of the 5 kinds of solutions shown below, silver iodobromide emulsions EM - 23 and EM - 24 each containing 3.7 mole % of silver iodide having no core/-shell structure, respectively, were prepared. A seed grain was a mono-dispersed silver iodobromide emulsion containing 3.7 mole % of silver iodide and each of the emulsion grains has an average grain diameter of 0.8 μm and a fluctuation coefficient of the grain distribution of 12%.

| | |
|---|---|
| (Solution $A_4$-2) | |
| Ossein gelatin | 22.5 g |
| Distilled water | 6799 ml |
| Polyisopropylene-polyethyleneoxy-disuccinic acid ester sodium salt 10% ethanolic aqueous solution | 20 ml |
| 4-Hydroxy-6-methyl-1,3,3a,7-tetra-azaindene | amount as shown in Table 30 |
| 28% Aqueous ammonia | 469 ml |
| Seed grain | amount corresponding to 0.8828 mole |
| (Solution $B_4$-2) | |
| Ossein gelatin | 24.0 g |
| KBr | 962 g |
| KI | 51.6 g |
| 4-Hydroxy-6-methyl-1,3,3a,7-tetra-azaindene | amount as shown in Table 30 |
| Distilled water | 2024 ml |
| (Solution $E_4$-2) | |
| $AgNO_3$ | 1109 g |
| 28% Aqueous ammonia | 904 ml |
| Made up to 1866 ml with addition of distilled water. | |
| (Solution $F_4$-2) | |
| 50% KBr aqueous solution | amount necessary for pAg adjustment |
| (Solution $G_4$-2) | |
| 56% Acetic acid solution | amount necessary for pH adjustment |

TABLE 30

| | Amount of tetraazaindene added | |
|---|---|---|
| Emulsion | Solution $A_4$ - 2 | Solution $B_4$ - 2 |
| EM-23 | 0 mg | 0 mg |
| EM-24 | 415 mg | 252 mg |

At 50° C., by means of a mixing stirrer as in Example 1, the solution $A_4$ - 2 was mixed with the solution $E_4$ - 2 and the solution $B_4$ - 2 according to the simultaneous mixing method. The pAg, pH and the addition rate of the solution $E_4$ - 2 during the simultaneous mixing were controlled as shown in Table 32. The controlling of the pAg and pH were carried out by using a flow rate variable roller tube pump while varing the flow rates of the solution $F_4$ - 2 and the solution $G_4$ - 2.

Two minutes after from the completion of the addition of the solution $E_4$ - 2, pAg of the mixture was adjusted to 10.4 with the solution $F_4$ - 2, and further 2 minutes later, adjusted to pH 6.0 with the solution $G_4$ - 2.

Next, the desalting and washing were carried out in a conventional manner, and the mixture was dispersed in the aqueous solution containing 127 g of ossein gelatin and the total amount was adjusted to 3000 ml with distilled water. All EM - 21, EM - 22, EM - 23 and EM - 24 have an average grain size of 1.6 μm and a fluctuation coefficient of grain distribution of 11%. Each of core/shell structures were shown in Table 32.

TABLE 31

| Emulsion | | Core/shell structure EM-21 | EM-22 | EM-23 | EM-24 |
|---|---|---|---|---|---|
| Core | Average grain diameter (μm) | 0.8 | 0.8 | | |
| | Composition | Silver iodobromide (AgI: 2.6 mole %) | Silver iodobromide (AgI: 2.6 mole %) | | |
| Shell (A) | Thickness (μm) | 0.16 | 0.16 | Single composition of silver iodobromide containing 3.7 mole % of I | |
| | Composition | Silver iodobromide (AgI: 15 mole %) | Silver iodobromide (AgI: 15 mole %) | | |
| Shell (B) | Thickness (μm) | 0.04 | 0.04 | | |
| | Composition | Silver iodobromide (AgI: 5 mole %) | Silver iodobromide (AgI: 5 mole %) | | |
| Shell (C) | Thickness (μm) | 0.20 | 0.20 | | |
| | Composition | Silver iodobromide (AgI: 0.3 mole %) | Silver iodobromide (AgI: 0.3 mole %) | | |
| Average grain diameter (μm) | | 1.6 | 1.0 | 1.0 | 1.0 |
| Crystal habit | | (100), (110)*1 | (110)*2 | (100)*3 | (110) |

[Notes]
(1) Core, Shell (A), Shell (B) and Shell (C) are positioned from the center of the grain to outer surface side of the grain in the order.
(2) *1 shows that the outer surface of the grain primarily comprises (100) face and (110) face.
(3) *2 and *3 show that the outer surfaces of the grains primarily comprise (110) face or (100) face, respectively.

TABLE 32

| Condition of grain growth | | | Addition rate of Solution (ml/min) | |
|---|---|---|---|---|
| Time | pAg | pH | Solution $E_4$-2 | Solution $B_4$-2 |
| 0.00 | 8.6 | 9.00 | 10.58 | 10.58 |
| 5.42 | 8.6 | 9.00 | 11.78 | 11.78 |
| 10.34 | 8.6 | 9.00 | 12.83 | 12.83 |
| 15.63 | 8.6 | 9.00 | 13.91 | 13.91 |
| 20.55 | 8.6 | 9.00 | 14.86 | 14.86 |
| 25.18 | 8.6 | 9.00 | 15.70 | 15.70 |
| 30.18 | 8.6 | 9.00 | 16.56 | 16.56 |
| 35.13 | 8.6 | 9.00 | 21.41 | 21.41 |
| 40.03 | 8.6 | 9.00 | 49.20 | 49.20 |
| 45.01 | 8.6 | 8.54 | 86.45 | 86.45 |
| 47.56 | 8.6 | 8.21 | 95.79 | 95.79 |
| 50.10 | 8.6 | 7.88 | 86.29 | 86.29 |
| 52.02 | 8.6 | 7.67 | 69.74 | 69.74 |

TABLE 32-continued

| Condition of grain growth | | | Addition rate of Solution (ml/min) | |
|---|---|---|---|---|
| Time | pAg | pH | Solution $E_4$-2 | Solution $B_4$-2 |
| 53.96 | 8.6 | 7.50 | 56.46 | 56.46 |

EXAMPLE 16

By use of the six kinds of solutions shown below, core/shell type silver iodobromide emulsions EM - 25 and EM - 26 each containing silver iodide content of 3.5 mole % and 0.3 mole % from the inner portion of a grain in the order, respectively, were prepared. A seed grain was a mono-dispersed silver iodobromide emulsion containing 2.6 mole % of silver iodide and each of the emulsion grains has an average grain diameter of 0.27 μm and a fluctuation coefficient of the grain distribution of 12%.

| | |
|---|---|
| (Solution $A_4$-3) | |
| Ossein gelatin | 34.6 g |
| Distilled water | 7643 ml |
| Polyisopropylene-polyethyleneoxy-disuccinic acid ester sodium salt 10% ethanolic aqueous solution | 20 ml |
| 4-Hydroxy-6-methyl-1,3,3a,7-tetra-azaindene | amount as shown in Table 33 |
| 28% Aqueous ammonia | 117 ml |
| Seed grain | amount corresponding to 0.2715 mole |
| (Solution $B_4$-3) | |
| Ossein gelatin | 41.0 g |
| KBr | 1615 g |
| KI | 83 g |
| 4-Hydroxy-6-methyl-1,3,3a,7-tetra-azaindene | amount as shown in Table 33 |
| Distilled water | 3456 ml |
| (Solution $C_4$-3) | |
| Ossein gelatin | 15.0 g |
| KBr | 610 g |
| KI | 2.6 g |
| 4-Hydroxy-6-methyl-1,3,3a,7-tetra-azaindene | amount as shown in Table 33 |
| Distilled water | 1266 ml |
| (Solution $D_4$-3) | |
| $AgNO_3$ | 1213 g |
| 28% Aqueous ammonia | 950 ml |
| Made up to 2040 ml with addition of distilled water. | |
| (Solution $E_4$-3) | |
| 50% KBr aqueous solution | amount necessary for pAg adjustment |
| (Solution $F_4$-3) | |
| 56% Acetic acid solution | amount necessary for pH adjustment |

TABLE 33

| Emulsion | Amount of tetraazaindene added Solution $A_4$-1 | Solution $B_4$-1 | Solution $C_4$-1 |
|---|---|---|---|
| EM-25 | 269 mg | 277 mg | 101 mg |
| EM-26 | 605 mg | 623 mg | 228 mg |

At 40° C., by means of a mixing stirrer as in Example 1, the solution $A_4$ - 3 was mixed with the solution $D_4$ - 3 and the solution $B_4$ - 3 according to the simultaneous mixing method, and the solution $C_4$ - 3 was added thereto at which the same time with the addition completion of the solution $B_4$ - 3. The pAg, pH and the addition rate of the solutions $D_4$ - 3, $B_4$ - 3 and $C_4$ - 3 during the simultaneous mixing were controlled as shown in Table 34. The controlling of the pAg and pH were carried out by using a flow rate variable roller tube pump while varing the flow rates of the solution $E_4$ - 3 and the solution $F_4$ - 3.

Two minutes after from the completion of the addition of the solution $D_4$ - 3, pAg of the mixture was adjusted to 10.4 with the solution $E_4$ - 3, and further 2 minutes later, adjusted to pH 6.0 with the solution $F_4$ - 3.

TABLE 34

| | | | Condition of grain growth | | |
|---|---|---|---|---|---|
| | | | Addition rate of Solution (ml/min) | | |
| Time | pAg | pH | Solution $D_4$-3 | Solution $B_4$-3 | Solution $C_4$-3 |
| 0.00 | 8.6 | 9.00 | 5.41 | 5.41 | |
| 6.14 | 8.6 | 8.97 | 7.86 | 7.86 | |
| 10.59 | 8.6 | 8.95 | 10.37 | 10.37 | |
| 15.54 | 8.6 | 8.92 | 14.26 | 14.26 | |
| 20.35 | 8.6 | 8.88 | 19.57 | 19.57 | |
| 25.53 | 8.6 | 8.82 | 27.56 | 27.56 | |
| 30.51 | 8.6 | 8.74 | 37.36 | 37.36 | |
| 35.32 | 8.6 | 8.63 | 46.63 | 46.63 | |
| 40.08 | 8.6 | 8.51 | 54.07 | 54.07 | |
| 45.22 | 8.6 | 8.36 | 55.76 | 55.76 | |
| 50.24 | 8.6 | 8.22 | 57.97 | 57.97 | |
| 52.66 | 8.6 | 8.14 | 58.18 | 58.18 | 58.18 |
| 55.10 | 8.6 | 8.07 | 57.41 | | 57.41 |
| 57.59 | 8.6 | 8.00 | 56.07 | | 56.07 |

Next, the desalting and washing were carried out in a conventional manner, and the mixture was dispersed in the aqueous solution containing 128 g of ossein gelatin and the total amount was adjusted to 3000 ml with distilled water.

Each of EM - 25 and EM - 26 has an average grain size of 0.8 μm and a fluctuation coefficient of grain distribution of 10%. Each of the core/shell structures was shown in Table 35.

TABLE 35

| | | Core/shell structure | |
|---|---|---|---|
| | Emulsion | EM-25 | EM-26 |
| Core | Average grain diameter (μm) | 0.27 | 0.27 |
| | Composition | Silver iodobromide (AgI: 2.6 mole %) | Silver iodobromide (AgI: 2.6 mole %) |
| Shell (A) | Thickness (μm) | 0.255 | 0.255 |
| | Composition | Silver iodobromide (AgI: 3.5 mole %) | Silver iodobromide (AgI: 3.5 mole %) |
| Shell (B) | Thickness (μm) | 0.02 | 0.02 |
| | Composition | Silver iodobromide (AgI: 0.3 mole %) | Silver iodobromide (AgI: 0.3 mole %) |
| Average grain diameter (μm) | | 0.8 | 0.8 |
| Crystal habit | | (100), (110) | (110) |

EXAMPLE 17

To 0.8 g of emulsions EM - 22, EM - 23 and EM - 24 as described in Table 31 of Example 15 each of which was applied optimally with gold and sufur sensitization and also subjected to blue-sensitive sensitization, were added a dispersion which had been prepared by emulsifying 0.6 g of TCP dissolved therein 1.30 g of the yellow coupler (Y - 1) in an aqueous solution containing 1.5 g of gelatin, an extender and a hardening agent which were conventional photographic additives, and the composition was coated on a film base which had been carried out a subbing treatment and dried to obtain Samples No. 20 to No. 22 (where Sample No. 20 was used EM - 22, Sample No. 21 was EM - 23 and Sample No. 22 was EM - 24).

In the above, amounts of each components show amounts per 1 $m^2$. The silver halide is shown in terms of silver.

The thus prepared each of Samples was subjected to a wedge exposure through a white light and then carried out a developing processing in the same manner by using the same solutions as in Example 4.

The obtained characteristic curves are shown in FIG. 32. In the Figure, reference numeral 6 is Sample No. 20 (EM - 22), reference numeral 7 is Sample No. 21 (EM - 23) and reference numeral 8 is Sample No. 22 (EM - 24). Further, $S_1$ sensitivity and $S_2$ sensitivity are shown in Table 36. In this case, the $S_1$ sensitivity and the $S_2$ sensitivity are shown by the relative value to Sample No. 21 as the reciprocal of the developing quantity providing $D_{min}+0.1$ and $D_{min}+0.5$ when the minimum concentration is defined as $D_{min}$, respectively.

Further, γ represents a value showing a decline of the characteristic curve between two points of log E=1.7 and log E=1.0.

TABLE 36

| Measured light | Characteristic value | Sample No. 20 (EM-22) | Sample No. 21 (EM-23)- | Sample No. 22 (EM-24) |
|---|---|---|---|---|
| B | $S_1$ sensitivity | 132 | 100 | 135 |
| | $S_2$ sensitivity | 130 | 100 | 132 |
| | Fog | 0.12 | 0.17 | 0.12 |
| | γ | 0.72 | 0.69 | 0.87 |

As seen from FIG. 32 and Table 36, the emulsions containing silver halide grains of the present invention has extremely high sensitivity and wide exposure range.

EXAMPLE 18

Multi-layer color films Samples No. 23, No. 24 and No. 25 were prepared with the layer constitution as shown in Table 37 below by providing them on a support having a halation preventing layer provided by coating thereon.

In Table 37, B, G and R represent a blue-sensitive layer, a green-sensitive layer and a red-sensitive layer, respectively, H, $H_1$, $H_2$ and $H_3$ high-sensitivity layers, L a low-sensitivity layer, I an intermediate layer, YC a yellow filter layer, Pr a protective layer and Base a support.

Each amount of the components indicated for respective layers of the sample shows an amount per 1 $m^2$. Further, an amount of the silver halide and colloidal silver were indicated as calculated on silver.

TABLE 37

| Sample No. | | |
|---|---|---|
| 23 | 24 | 25 |
| Pr | Pr | Pr |
| $BH_1$ | $BH_2$ | $BH_3$ |
| BL | BL | BL |
| YC | YC | YC |
| GH | GH | GH |
| GL | GL | GL |

TABLE 37-continued

| Sample No. | | |
|---|---|---|
| 23 | 24 | 25 |
| I | I | I |
| RH | RH | RH |
| RL | RL | RL |
| Base | Base | Base |

The respective layers are as follows:

RL

The same as RL in Example 4.

RH

The same as RH in Example 4.

GL

The same as GL in Example 4.

GH

The same as GH in Example 4.

BL

The same as GH in Example 4.

$BH_1$

A high-sensitivity blue-sensitive emulsion layer containing dispersants prepared by dissolving, in 0.65 g of TCP, 0.8 g of a cubic mono-dispersed emulsion (EM - 23) comprising AgBrI containing 3.7 mole % of AgI and having an average grain diameter of 1.60 μm and a fluctuation coefficient of grain distribution of 11% applied optimally with gold and sulfur sensitization and also subjected to blue-sensitive sensitization and 1.30 g of the yellow coupler (Y - 1), and emulsifying them into an aqueous solution containing 1.5 g of gelatin.

$BH_2$

A high-sensitivity blue-sensitive emulsion layer which is the same as the above $BH_1$ except for replacing the emulsion (EM - 23) in the above layer $BH_1$ with a dodecahedral mono-dispersed emulsion (EM - 24) comprising AgBrI containing 3.7 mole % of AgI and having an average grain diameter of 1.60 μm and a fluctuation coefficient of grain distribution of 11% according to the present invention.

$BH_3$

A high-sensitivity blue-sensitive emulsion layer which is the same as the above $BH_1$ except for replacing the emulsion (EM - 23) in the above layer $BH_1$ with a dodecahedral mono-dispersed emulsion (EM - 22) comprising AgBrI containing 2.6 mole %, 15 mole %, 5 mole % and 0.3 mole % of AgI from the inner portion of the grain to the outer surface of the grain in the order and having an average grain diameter of 1.60 μm and a fluctuation coefficient of grain distribution of 11% according to the present invention.

YC

An intermediate layer containing 0.04 g of n-dibutyl phthalate having dissolved therein 0.15 g of a yellow colored colloidal silver and 0.2 g of 2,5-di-t-octylhydroquinone (stain preventing agent), and 0.8 g of gelatin.

I

An intermediate layer containing 0.8 g of gelatin and dibutylphthalate (DBP) having dissolved therein 0.07 g of 2,5-di-t-octylhydroquinone (HQ - 1).

Pr

A gelatin protecting layer.

The thus prepared each of Samples No. 23, No. 24 and No. 25 was subjected to a wedge exposure by using a white light and then the developing processings were carried out in the same manner as in Example 17.

The obtained $S_1$ sensitivity and $S_2$ sensitivity are shown in Table 38.

In this case, the $S_1$ sensitivity and the $S_2$ sensitivity are shown by the relative value to Sample No. 23 as the reciprocal of the developing quantity providing $D_{min}+0.1$ and $D_{min}+0.5$ when the minimum concentration is defined as $D_{min}$, respectively.

Further, $\gamma$ represents a value showing a decline of the characteristic curve between two points of log E=1.7 and log E=1.0.

TABLE 38

| Measured light | Characteristic value | Sample No. 23 | Sample No. 24 | Sample No. 25 |
|---|---|---|---|---|
| B | $S_1$ sensitivity | 100 | 135 | 132 |
| | $S_2$ sensitivity | 100 | 132 | 132 |
| | $D_{min}$ | 0.16 | 0.12 | 0.12 |
| | $D_{max}$ | 1.30 | 1.35 | 1.50 |
| | $\gamma$ | 0.65 | 0.82 | 0.67 |

As seen from Table 38, the light-sensitive photographic material No. 25 of the present invention has extremely high sensitivity as compared with the Comparative Sample No. 323 and has improved latitude as compared with the Sample No. 24 which has no core/-shell structure.

The silver halide grain according to the present invention is excellent in sensitivity and fog relationship with respect to the shape of the photographic emulsion as compared with a normal grain of cubic, octahedral or tetradecahedral each comprising, the outer surface thereof, (100) face and (111) face, and a plane twin crystal.

The light-sensitive photographic material according to this invention is excellent in sensitivity and fog relationship as compared with the light-sensitive material using the grain as mentioned above which comprises, the outer surface thereof, (100) face and (111) face.

The preparative method of the present invention could be effected to preparation of the silver halide grain according to the present invention which is useful as mentioned above and novel.

Further, according to the present invention, sensitivities of the silver halide emulsion having hybrid silver halide crystals and light-sensitive silver halide photographic materials.

We claim:

1. Hybridized silver salt crystal grains, comprising crystals of developable silver salts formed by epitaxial junction on the host grains consisting substantially of silver iodobromide or silver bromide having (110) faces and/or semi-(110) faces.

2. A silver halide photographic emulsion, comprising hybridized silver salt crystal grains comprising crystals of developable silver salts formed by epitaxial junction on the host grains consisting substantially of silver iodobromide or silver bromide having (110) faces and/or semi-(110) faces.

3. A silver halide photographic emulsion according to claim 2, wherein the ratio of the (110) faces and/or semi-(110) faces relative to the total surface area in the host grains is 30% or more.

4. A silver halide photographic emulsion according to claim 2, wherein the ratios of the respective diffraction line intensities on the (111), (200) and (220) faces as determined by the powdery X-ray diffraction are as follows:

$$(220)/(111) \geqq 8\%$$

$$(220)/(200) \geqq 5\%.$$

5. A silver halide photographic emulsion according to claim 2, wherein the content of silver iodide in the host grains is 0 to 40 mole %.

6. A silver halide photographic emulsion according to claim 2, wherein the silver salt epitaxially junctioned is at least one selected from silver iodobromide, silver bromide, silver chlorobromide, silver chloride, silver thiocyanate, silver cyanide, silver carbonate, silver ferricyanate, silver arsenate, silver arsenite and silver chromate.

7. A silver halide photographic emulsion according to claim 2, wherein the silver salt epitaxially junctioned is selected from silver chloroiodide, silver chloroiodobromide and silver iodobromide containing 0 to 10 mole % of silver iodide.

* * * * *